United States Patent [19]

Leon Moyano

[11] 3,987,912

[45] Oct. 26, 1976

[54] MOVABLE VEHICLE PARKING TOWERS

[76] Inventor: Rafael Leon Moyano, Obispo Mardonc, 78, Cordoba, Spain

[22] Filed: Dec. 5, 1974

[21] Appl. No.: 530,026

Related U.S. Application Data

[63] Continuation-in-part of Ser. No. 332,756, Feb. 15, 1973, abandoned.

[30] Foreign Application Priority Data

June 3, 1972 Spain ..... 403,493
Jan. 9, 1973 Spain ..... 410,480

[52] U.S. Cl. ..... 214/16.1 C
[51] Int. Cl.[2] ..... E04H 6/06
[58] Field of Search ..... 214/16.1 R, 16.1 C, 214/16.1 CB, 16.1 CC, 16.1 CD, 16.1 CE

[56] References Cited

UNITED STATES PATENTS

| | | | |
|---|---|---|---|
| 2,647,647 | 8/1953 | Alimanestiang | 214/16.1 CB |
| 2,849,126 | 8/1958 | Kerekes | 214/16.1 CD |
| 3,294,260 | 12/1966 | Franges | 214/16.1 CE |
| 3,414,141 | 12/1968 | Rougemont | 214/16.1 CC |
| 3,774,784 | 11/1973 | Glass | 214/16.1 CE |

FOREIGN PATENTS OR APPLICATIONS

| | | | |
|---|---|---|---|
| 78,440 | 6/1962 | France | 214/16.1 E |
| 1,357,229 | 2/1964 | France | 214/16.1 R |
| 1,484,615 | 5/1967 | France | 214/16.1 R |
| 1,070,366 | 12/1959 | Germany | 214/16.1 CD |

*Primary Examiner*—Robert J. Spar
*Assistant Examiner*—R. B. Johnson
*Attorney, Agent, or Firm*—Wenderoth, Lind & Ponack

[57] ABSTRACT

A vehicle parking system includes a large parking area free of intermediate floors. A plurality of multi-storied vehicle towers are movable within tracks on the floor of the parking area from a plurality of selected parking spaces to vehicle entrances to the parking area. The vehicle entrance may include ramps to lead the vehicles to the towers, which then have means to displace the vehicle onto or from the tower. Alternatively, the vehicle entrance may have cargo hoist units with means to transport thereto a vehicle, the cargo hoist unit then being vertically movable to align with a selected tower floor. The vehicle is then displaced onto the tower floor by devices located either on the tower floor or on the cargo hoist unit. Various devices are provided to move the towers within the parking area and to turn the wheels thereof in a horizontal plane.

7 Claims, 40 Drawing Figures

MOVABLE VEHICLE PARKING TOWERS

This is a continuation-in-part of application Ser. No. 332,756, filed Feb. 15, 1973, now abandoned.

BACKGROUND OF THE INVENTION

The present invention is directed to an automated vehicle parking system. More particularly, the present invention is directed to such a system wherein vehicles to be parked are automatically placed in a moveable multi-storied tower, and the tower is automatically moved to a location, indicated by predetermined coordinates of a grid coordinate system, of a parking area.

Many types of vehicle parking garages or lots are known. However, all known parking systems suffer from certain inherent disadvantages. That is, all known parking systems require either a great deal of manual labor to place and remove vehicles, or a great amount of space for a given vehicle capacity. Further, in known automated or semi-automated parking systems, the building structure of necessity has high structural strength requirements.

SUMMARY OF THE INVENTION

Consequently, a primary object of the present invention is to provide in accordance with one embodiment of the invention a vehicle parking system, preferably in the form of an underground parking lot. Entry, parking and withdrawal of the vehicles is carried out automatically by a known type of control system, which preferably may be a known electronic computer properly programmed by known techniques, and wherein the bay to be occupied, or that already occupied, by a vehicle, will always be movable.

Another object of the present invention is the provision of multi-storied towers, each of which houses various vehicles in superimposed planes or stories.

Another object of the invention is to provide mechanisms contemplated for introducing the vehicles into the towers or for withdrawing such vehicles from the towers.

A further object of the invention is to provide devices for blocking the vehicles in position at different floors of each tower. Such devices may comprise wedge-like elements which contact the wheels of the vehicle while such vehicle remains in the parking tower. Such wedges are moved to an unblocked position when the vehicle is withdrawn from the parking lot, and also when a vehicle has to enter one of the towers.

Another object of the present invention is to provide a cargo hoist system which may be provided in place of different leveled entry and exit ramps, so that by means of such cargo hoist system the vehicles may be deposited on the different floors of each parking tower.

Another object of the present invention is to provide means operable by the control system such as an electronic computer to move the towers in a programmed manner. These movement control means may include, in one embodiment of the invention, contact control panels situated at specific points in the roof of the underground parking or the parking lot itself. These contact panels may be combined with contacting devices arranged in the roof of each tower.

The contacting devices of the columns will act upon electronic, pneumatic or hydraulic mechanisms. Such mechanisms control levers which, according to the electric impulse received, will either be coupled to or uncoupled from intermittently moving traction or hauling chains, to thereby move the towers.

Another object of the invention is to provide a system for turning the wheels of the towers within a horizontal plane, so as to allow movement of the towers, the orientation of which does not change, in perpendicular directions. Such turning of the wheels of the towers is effected at points or areas at which the tracks along which the columns move, intersect.

The vehicle parking system according to a first embodiment of the present invention includes a plurality of towers, each one of which has various floors in which a vehicle can be housed. Such towers are movable and their displacements along roller tracks are preferably controlled by means of a control system such as a known electronic computer. That is, according to the system of the invention, the parking bay approaches a vehicle to be parked, or the parking bay moves towards the exit so that the vehicle can be withdrawn. The area of the parking lot itself, i.e. the tower storage area may be a building relatively free from structural footings and completely free from floor structures.

Entrance of vehicles into the parking lot and exit therefrom will be effected by mechanical means, such as, for example, lifts, cargo hoist units, or endless belts. Instead of such mechanical means, different leveled ramps may lead to the various floors of each tower.

The vehicle will enter or leave each tower automatically by the activation of mechanisms which operate as follows:

1. When the wheels of the vehicle entering the tower directly contact breakers, such as photoelectric cells, which have been provided for such purpose;

2. The same contacts will be operated by means of an electric impulse emitted by the electronic computer when a vehicle is to be withdrawn.

Vehicles may enter the towers in a direction along the longitudinal axis of such towers, i.e. head on. Alternatively, the vehicles may enter the towers along the transversal axis thereof. That is to say, a vehicle will enter a tower by moving forwards in its normal direction of travel, or it can be moved perpendicular to such normal direction of travel, i.e. sideways. Use of the second process, i.e. transversal entrance of the vehicle into the tower is more advantageous because it will not be necessary to turn the towers in order to withdraw a vehicle from the parking lot, since vehicles should leave the parking system oriented in the same way as they entered, i.e. in the forward direction.

The towers may be displaced by electromotors, which can be fixed at suitable points in the parking lot or which can be movable. In any case, such motors can turn steering wheels to which endless transmission means, such as chains or cables, are coupled. These endless transmission means can be automatically temporarily coupled to devices existing in the roof of each tower.

In a further embodiment of the invention, a vehicle to be parked for a certain period of time is driven by its driver towards a receiving zone wherein the vehicle is detained, the front and back wheels of the vehicle being supported on horizontal displacing means which will displace the vehicle transversally. Before such transverse displacement of the vehicle takes place, the driver abandons the vehicle.

The transverse displacing means of the vehicle consist of endless belts.

The vehicle is thus moved towards a cargo hoist unit, immediately in front of which there are floor zones comprised of laths or bars which are parallel to and spaced from each other. The wheels of the vehicle will be supported on such lath zones, the vehicle being deposited there by the endless belts which displace it transversally.

Adjacent to the zone wherein the vehicle is being detained with its wheels supported on the lath zones, is a space for a cargo hoist unit having a plurality of loading floors, one of which is aligned with the vehicle. A device to displace the vehicle from the lath zone to the interior of the cargo hoist unit is then displaced horizontally from the floor of the cargo hoist unit.

The device to displace the vehicle into the cargo hoist unit comprises a pair of shovels which are rigidly fastened to a central frame. Each shovel is formed of various laths or bars which are separated from each other by a distance approximately equal to the distance which separates the laths of the lath zones on which the vehicle is detained in front of the cargo hoist unit.

Thus, such shovels will slide between the laths of the lath zones on which the wheels of the vehicle are supported. Raising of the shovels, for example by hydraulic activating means, will lift the vehicle. The shovels then retract towards the cargo hoist unit carrying the vehicle thereon.

What has taken place up to now has been done at a level above or below which, but preferably below, is found what will hereinafter be referred to as the parking area. Such parking area is the warehouse or storage area of the towers which bear the vehicles during the time in which they remain in the parking lot.

On the floor of the parking area there are tracks or rails along which tank trolleys, which move the towers, will move.

The space of the parking area is divided into rectangular areas which will be the spaces to be occupied by the towers at rest while housing vehicles in their various floors. There will also be provided free-circulating lanes for the trolleys or platforms which are moved to displace the towers. Normally, the trolleys are moved only when it is necessary to change the position of a tower.

The towers are rigid structures made from metallic profiles which have various superimposed floors, each one of which is capable of housing a vehicle.

The ground of the various floors of each tower has lath zones to support the front and back wheels of the vehicle to be deposited on such floors. These lath zones are similar to those immediately adjacent the cargo hoist unit. Thus, a vehicle introduced into the cargo hoist unit, as explained above, will be displaced from such cargo hoist unit to the tower expressly situated next to such cargo hoist unit, using the same device which served to introduce the vehicle into the cargo hoist unit itself.

It can be understood that the cargo hoist unit will have a vertical path of travel, so that it may be made level with the different floors of the tower.

Although only one floor is necessary, it is advisable to use a cargo hoist unit which has at least two floors.

It can be understood that the vehicle admission sequence will be reversed when a vehicle should be withdrawn from the parking lot.

Movement of the towers within the parking area is carried out by means of trolleys or platforms which will hereinafter be referred to as power cars.

Each one of these power cars comprises a rectangular rigid frame, equivalent in size to that of the base of the tower.

The height of these power cars is smaller than the distance existing between the surface of the lower floor of each tower and the ground of the parking area. Thus, the power cars can pass beneath the towers, to be placed below any one of them and to proceed, as will subsequently be described, with its displacement.

The power cars have four trucks or carriages, each one of which has three wheels which are equal to each other. These trucks have their own driving source, preferably independent of each other.

The trucks are mounted on a vertical shaft, on the side members of the frame which form the power car. These shafts, and consequently the trucks, can be rotated in an angle of 90° within a horizontal plane, to thus achieve a change in the direction of travel of the power car. A change of direction perpendicular to a preceding direction will thereby be obtained.

The four vertices of the power car itself have a similar number of hydraulic pumps or jacks which are directed upwards, by means of which raising of a tower beneath which the power car has been placed can be accomplished, so that the supports of the tower are moved out of contact with the parking area floor, and the tower can thus be displaced.

There are a second group of four hydraulic pumps or jacks pointing downwards from the frame of the power car, so that by means thereof raising of the power car is achieved until the trucks lose contact with the rails and the turning of the trucks may be carried out in order to change the direction of travel of the power car. It will be understood that this operation will be produced in those areas where there are track or rail crossings.

The driving power of the power cars for their displacements, as well as for activating the hydraulic pumps, will be facilitated by means of electrical energy which can be supplied in a known manner, e.g. by means of a known friction brush incorporated in the frame of the power car, through which brush electric current reaches from a conductor placed between the roller tracks.

It should be pointed out that control of the movement of the different mechanisms and devices which as a whole form a parking lot according to the invention, will be guided by a remote control. That is to say, they will be controlled by means of programmed electric impulses, preferably, by a known type of electronic computer.

The sequence of operation of the various mechanisms of this embodiment of the parking lot of the invention can be summarized as follows:

1. When the occupants leave a vehicle to be parked in the zone wherein there are endless belts, displacement of the vehicle will take place transversally.

2. The vehicle is passed to the cargo hoist unit by means of a collecting device which is incorporated in cargo hoist unit.

3. The cargo hoist unit descends, if the parking lot is underground, until it reaches the level corresponding to a free floor of a tower which has been situated adjacent to the cargo hoist unit.

4. The vehicle is displaced to the free floor of the tower.

5. A power car is situated below the tower and lifts the tower from the ground of the parking area.

6. The tower is displaced to a parking rectangular area where it will remain until it receives the signal to move, which signal will be given when the user requests a vehicle deposited in such column.

It can be understood that phases 5 and 6 will preferably take place when all the bays of the tower are occupied. If this is not so, the tower will preferably remain next to the cargo hoist until it receives all the vehicles which it is capable of housing.

BRIEF DESCRIPTION OF THE DRAWINGS

Other objects and features of the automatic parking system according to the present invention will be more apparent from the following detailed description taken in conjunction with the attached drawings. In some figures there are hatched zones which refer to other figures which are enlarged views of such zones.

FIG. 3 shows a modification wherein the vehicles will be introduced into the towers transversally. Although this plan view illustrates means whereby access of the vehicles is effected by cargo lifts, series of different leveled ramps can also be used, as shown in FIG. 1;

DETAILED DESCRIPTION OF THE INVENTION

With reference to FIGS. 1–17*a*, a first embodiment of a vehicle parking system, preferably underground, generally designated 9, has a parking area with a floor including a large parking zone 10 and the service lanes 11. These service lanes 11 are those through which the towers travel during their maneuvers to collect vehicles or through which they are directed from the parking zones 10 to the entrance of the parking lot.

The columns will be identified, for control purposes, by coordinate numbers. Thus, the code corresponding to any vehicle can be obtained by placing the number of the floor or level occupied by a vehicle in a given tower before the number of such tower wherein such vehicle is situated.

Figure 1:
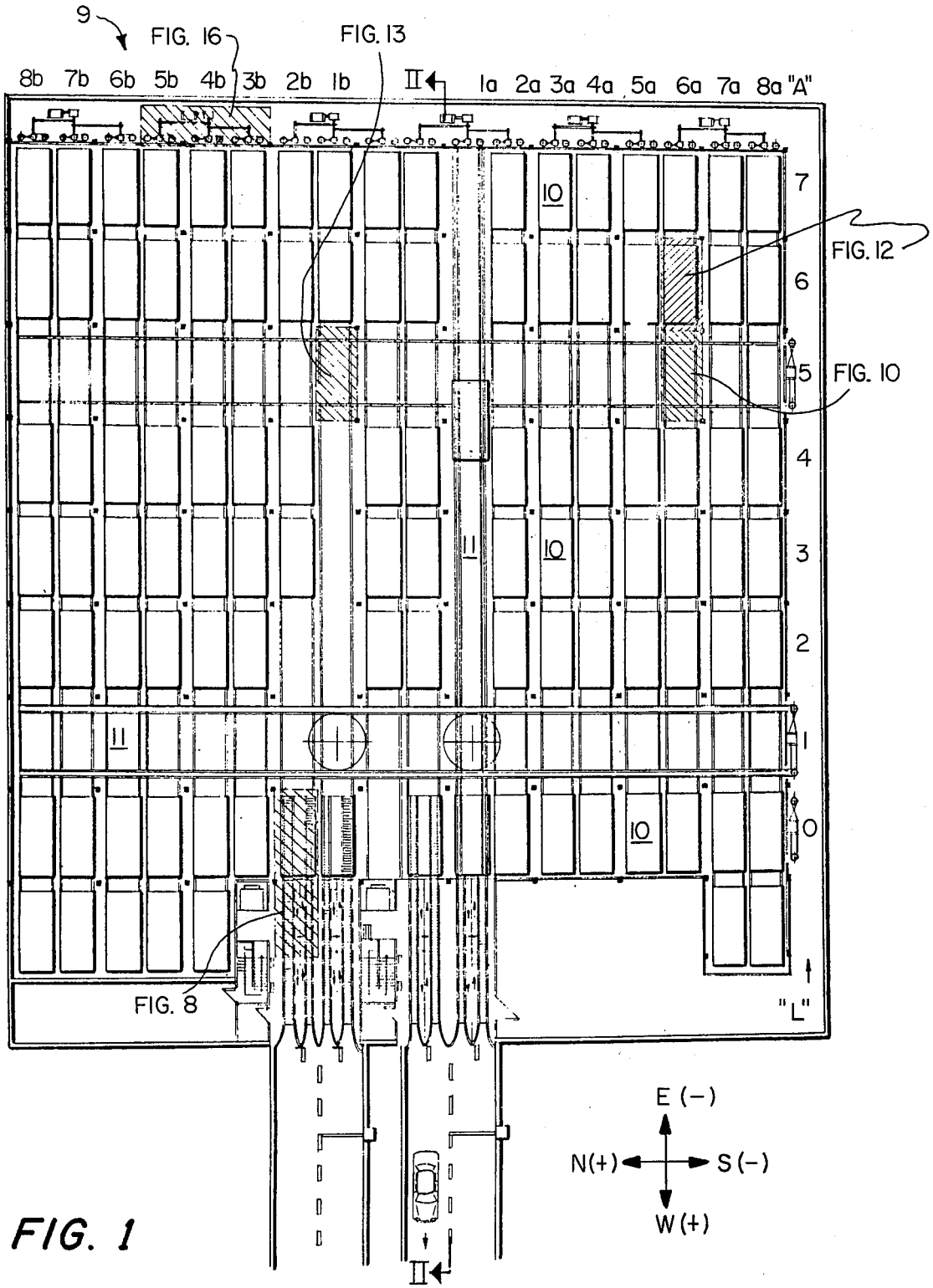
FIG. 1 is a schematic plan view of a first embodiment of a parking lot according to the present invention based on accesses through a series of different leveled ramps and entrance of vehicles into towers in the direction of the longitudinal axis of the towers, i.e. entry and exit of the vehicles in a forward direction. In this embodiment, the entry and exit ramps can be replaced by groups of cargo hoists.
Figure 2:
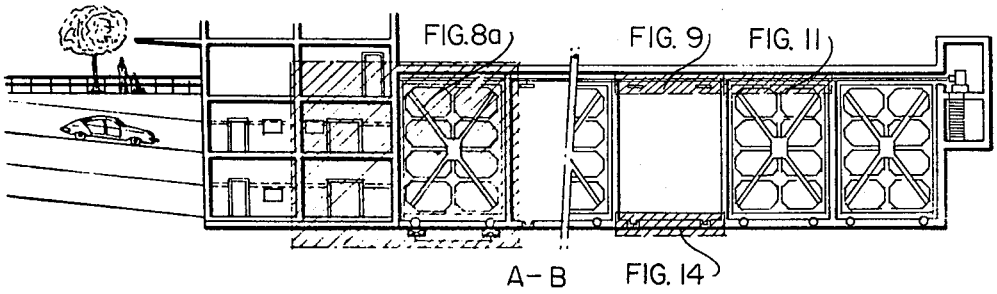
FIG. 2 is a section taken along lines II—II indicated in FIG. 1.
Figure 3:
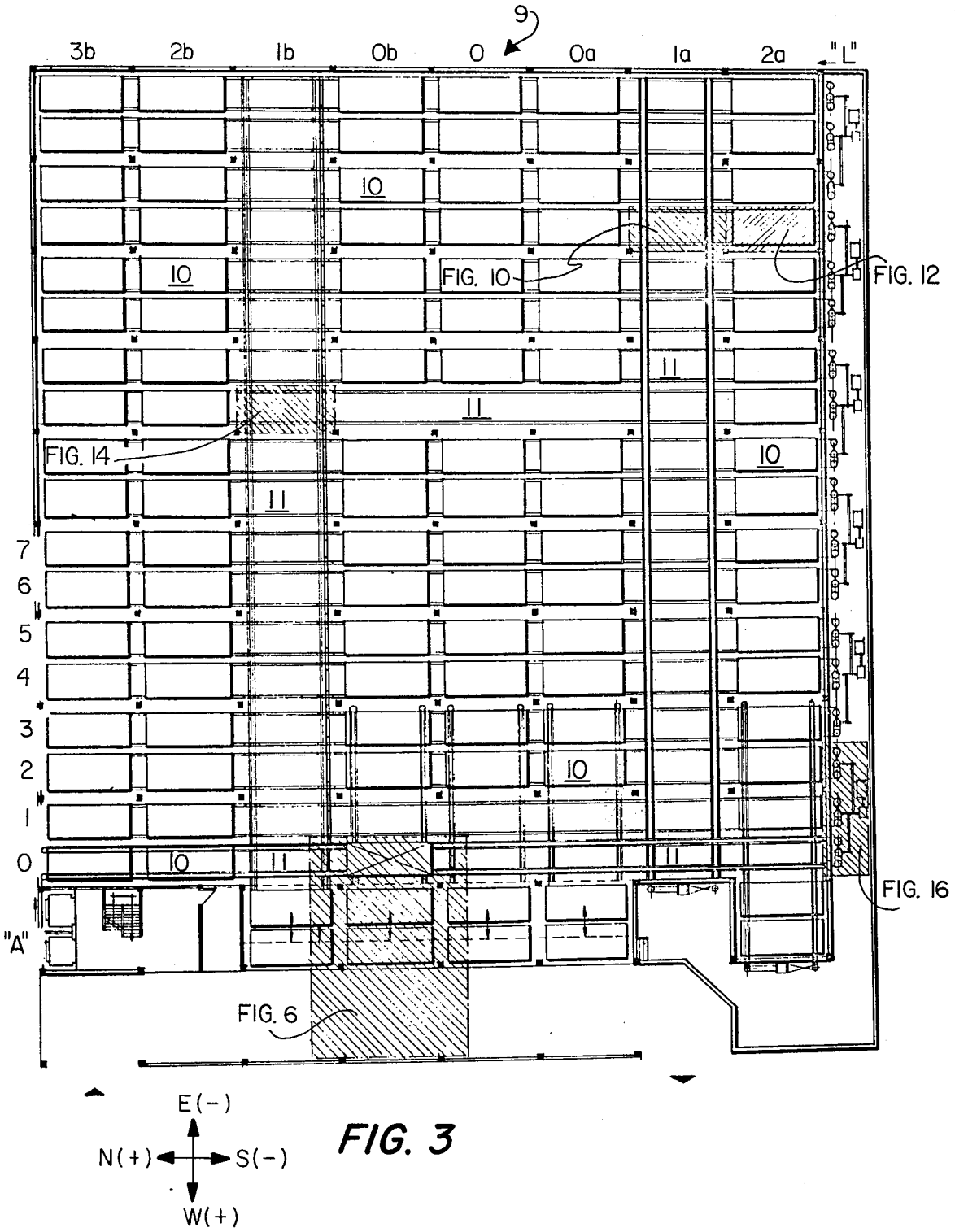
FIG. 3 is a plan view of a parking lot similar to that of FIG. 1, except that the towers are situated in a position perpendicular to that illustrated in FIG. 1, i.e. turned 90°, since

The floor of the parking area is divided into a grid by two series of coordinates, perpendicular to each other, which will be called A and L (see FIGS. 1 and 3). The intersections of series A and L form a network or grid indicating all possible positions where the columns may be located.

The service lanes 11 are identified in FIG. 1 by the coordinates 1 and 5 of series L and the coordinates $1_b$ and $1_a$ of series A.

The services lanes are identified in FIG. 3 by the coordinates $1_a$ and $1_b$ of series L and by the coordinates 0, 1 and 10 of series A.

The remaining intersections of coordinates both in FIGS. 1 and 3 correspond to the parking areas or spots where the towers are stored.

The control system, such as an electronic computer, will memorize the positions of all of the towers at all times, thus enabling the programming of the movement of the towers to change the position of vehicles.

Two main variants of cargo hoist units, generally designated M, which are normally considered as continuous cargo hoist for displacing the vehicles from the entrance of the parking lot to the columns, and vice versa, will be described with reference to FIGS. 5–7*b*. The number of cargo hoist units and floors therefor will depend upon the specific requirements of each parking lot.

Figure 5:
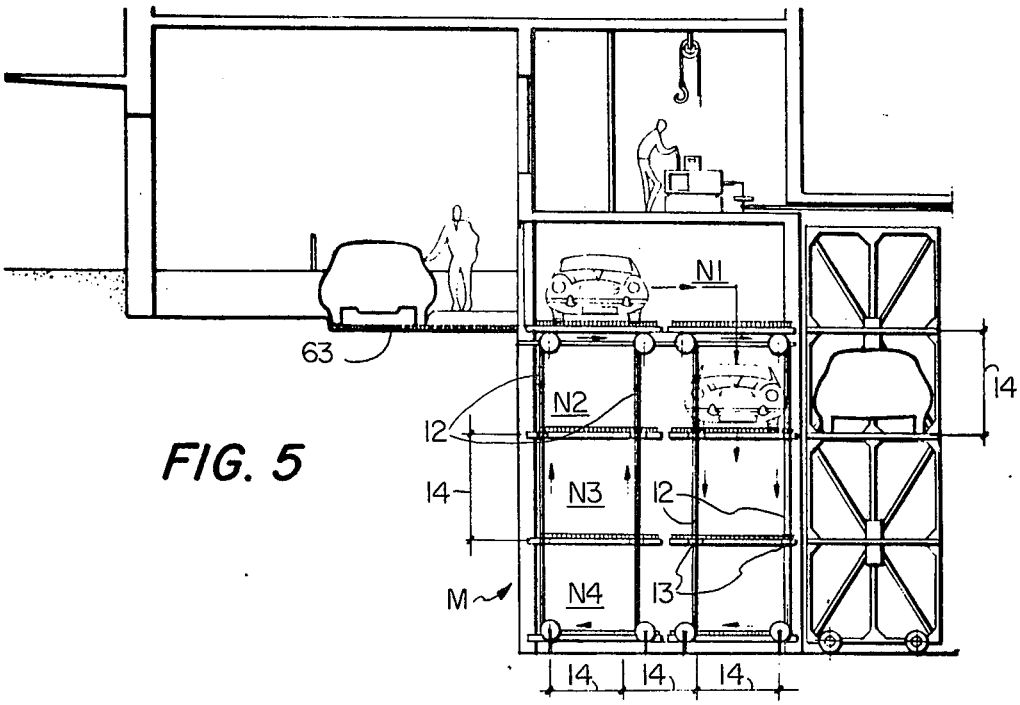
FIG. 5 is an enlarged side sectional elevational view of FIG. 4.
Figure 6:
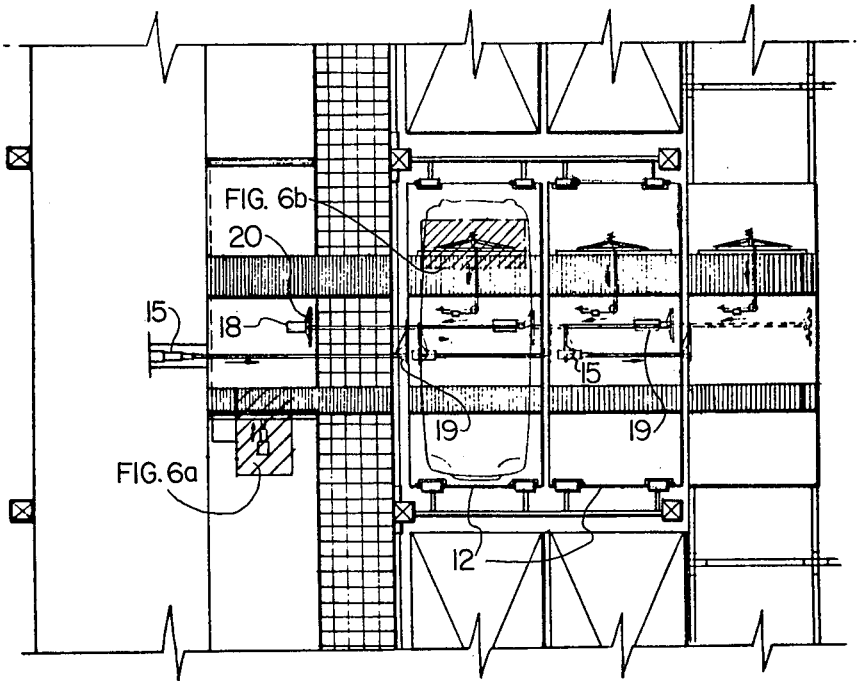
FIG. 6 is a plan view of that represented in FIG. 5, the position of which within the overall parking system is illustrated in FIG. 3, from which FIG. 6 has been enlarged and extracted.

These cargo hoist units can be of two types:

1. - Cargo hoist units whose movements are parallel to the entrance axis of vehicles, as shown in FIGS. 5 and 6.

Figure 7A:
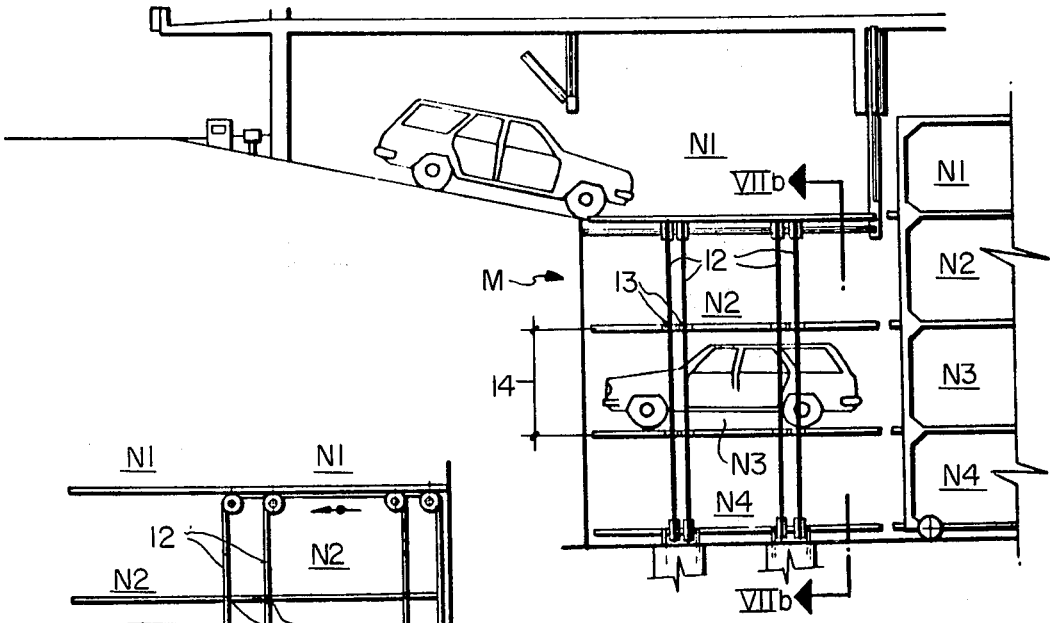
FIG. 7*a* is a sectional elevational view taken along lines VII*a*–VII*a* of FIG. 7.
Figure 7B:
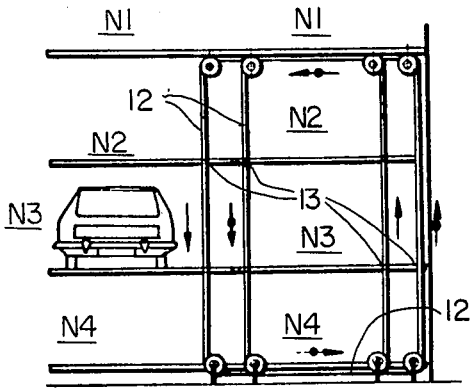
FIG. 7*b* is a view taken along lines VII*b*–VII*b* of FIG. 7*a;*
Figure 7:
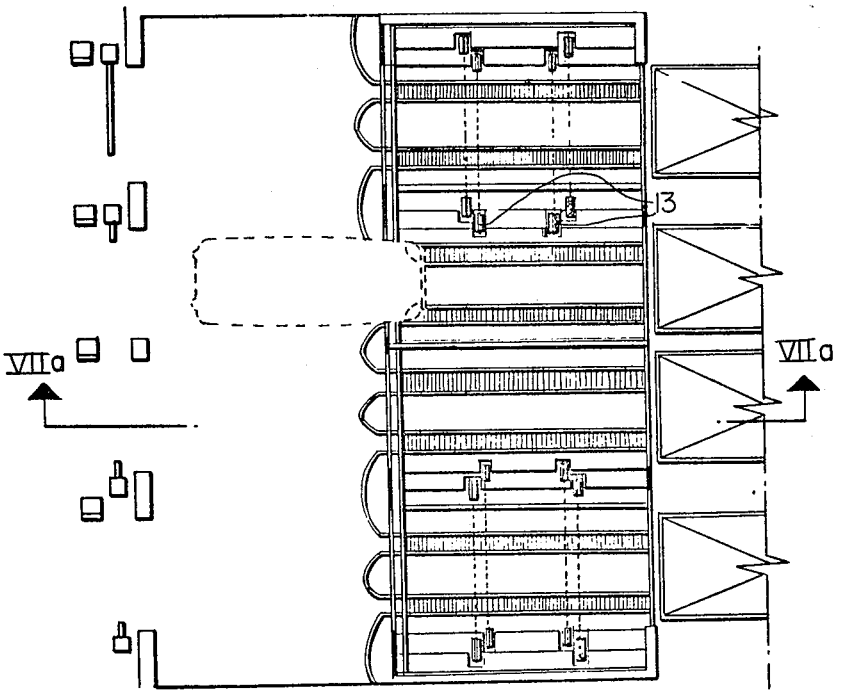
FIG. 7 is a plan view of the mode of access by means of cargo lift units with frontal entrance of the vehicle into the tower, this figure being a variant of the transversal entrance shown in FIGS. 6, 6*a* and 6*b;*

2. - Cargo hoist units whose movements are perpendicular to the entrance axis of the vehicles, as shown in FIGS. 7, 7*a* and 7*b*.

In any of the two types of the mentioned cargo hoist units, the levels of floors N1, N2, N3, N4, etc. are moved according to the path of chains 12 or other similar traction means. Chains 12 are fixed to each floor of the cargo hoist units by pairs of points 13.

For functioning of the cargo hoist unit, the arrangement should always be that the horizontal distance between the supports of the same circuit of chains 12 should be a multiple of distance 14, i.e. of the magnitude corresponding to the height between the floors of the cargo hoist unit and, consequently, of the floors of the columns.

When any floor of the cargo hoist unit has traveled the distance 14, a vehicle has been hoisted and another has, at the same time, been lowered. Thus, when the cargo hoist unit is displaced through a relatively short distance, distance 14, a stream of vehicles is moved in both directions. Thus, the simultaneous hoisting and lowering of vehicles, or what can be considered as the entrance into a tower and the simultaneous withdrawal of vehicles therefrom, are obtained. Therefore, there is the possibility at peak hours when there is an inflow of vehicles in one direction or another of disposing of the bay opposite to that of the inflow, thus doubling the efficiency of the cargo hoist units. This is particularly true, since the process of pushing or transporting the vehicles towards the different levels of the towers, by means of automatic devices, can be carried out separately or jointly.

The direction of movement of chains 12 which move the cargo hoist unit, can be contrary to that indicated in the drawings.

Vehicles can enter the towers in two positions, i.e. frontal with respect to the normal direction of travel of the vehicle (FIGS. 1 and 8), and lateral with respect to the direction of travel of the vehicle (FIGS. 3, 5 and 6). It should be noted that in this latter case the vehicle enters or leaves the tower sideways.

In the former case, i.e. frontal entry, the towers are rectangular bodies formed of metallic profiles and receive the vehicles through their smaller side surfaces.

In the latter case, i.e. lateral entry of vehicles, the towers receive such vehicles through their larger side surfaces.

In any case, the mechanical means for introducing vehicles into the towers or withdrawing the same therefrom may comprise hydraulic or pneumatic activated telescopic arms. These arms will push or pull the vehicles as such vehicle enters or leaves the tower, respectively. In order to facilitate movement of the vehicle when it is pulled or pushed, the floors of the towers are provided with zones having groups of freely rotating parallel rollers along which the vehicles slide. Other roller zones exist in the cargo hoist units.

Figure 8:
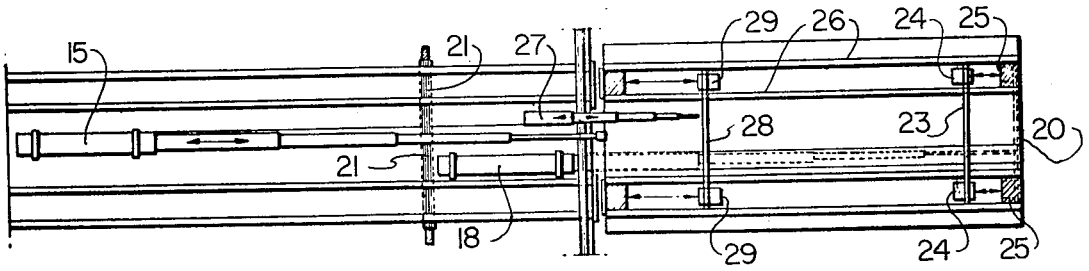
FIG. 8 is a plan view illustrating the system for providing frontal entrance and exit of the vehicles in the towers.
Figure 8A:
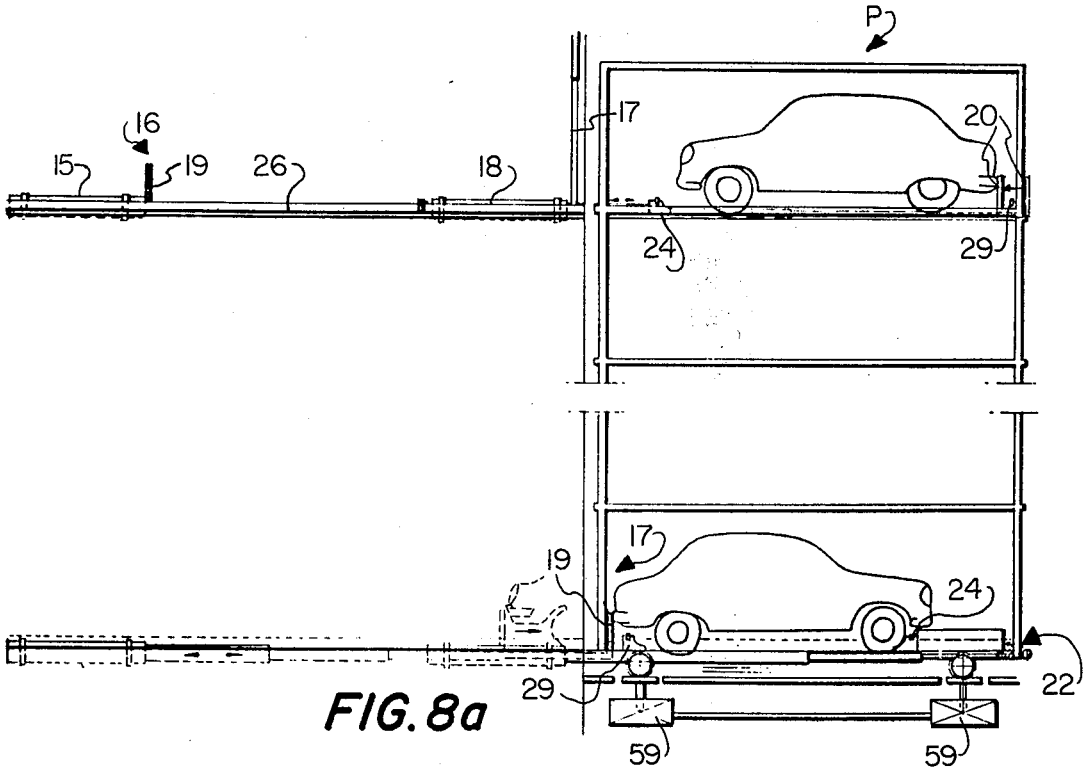
FIG. 8*a* is a side elevational view of the frontal entrance system of FIG. 8, the upper part of this figure showing removal of the vehicle from the tower, and the lower part thereof showing entrance of the vehicle into the column.
Figure 8B:
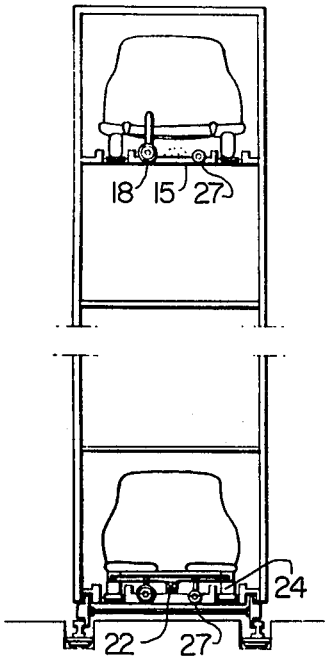
FIG. 8*b* is a front elevational view of the frontal entrance system of FIG. 8*a;*

As shown in FIGS. 8, 8*a* and 8*b*, a telescopic arm 15 introduces the vehicle into the tower P, moving such vehicle from position 16 to 17.

Another telescopic arm 18, similar to 15, is situated near the spot to which the tower (or ramp or cargo hoist) approaches in order to admit a vehicle. Both arm 15 as well as arm 18 have at their free ends a bend or elbow 19 and 20, respectively, which are laterally collapsible. The mentioned bends or elbows 19 and 20 are normally in a horizontal position, i.e., when arms 15 and 18, respectively, are withdrawn the bends or elbows do not project from the surface on which the vehicle moves. When the front wheels of the vehicle reach the area 21, a circuit is activated to lift the bend 19 from arm 15. Then the driver leaves the vehicle and goes to collect corresponding key, which can for example be a key or a performated card. When such key is withdrawn, the circuit will be fed. This circuit causes the telescopic arm 15 to extend from position 16, thus pushing the vehicle, at the center of the back bumper, until the vehicle has entered the tower. Bend 19 will then be in position 17. Before bend or elbow 19 reaches position 17, which is the maximum limit to which arm 15 can extend, arm 18 would have been put into operation, its corresponding bend 20 passing in front of the vehicle in a horizontal position, until it reaches the limit point 22 corresponding to the maximum length of telescopic arm 18. Bend 20 will then turn 180° and arm 18 moves backwards. Bend 20 encounters in this path crossbar 23, which at its ends, has rigidly attached thereto wedges 24 which were previously positioned in hollows 25 in the floor of the level of the tower wherein the vehicle has been introduced. Thus, crossbar 23 advances until the wedges 24 joined thereto strike the front wheels of the vehicle, thus causing blockage of wedges 24 in toothed edges of guides 26 along which the wedges slide, thus effecting fixing thereof. At the same time as blocking of such wedges 24 takes place, bend 20 is uncoupled from crossbar 23 and arm 18 moves backwards towards its initial position.

When arm 15 reaches its maximum length 17, a small auxiliary telescopic arm 27 moves, which arm pushes another crossbar 28, similar to crossbar 23 and also provided with wedges 29, to block the back wheels of the vehicle. The vehicle will then have been introduced by its leading edge into the tower and will have been blocked on the floor of the column.

Figure 8C:
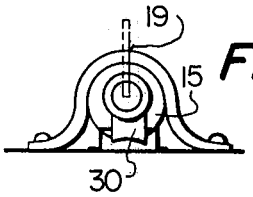
FIG. 8*c* is a front view of one of the extendible arms of the system of FIG. 8*a;*
Figure 8D:
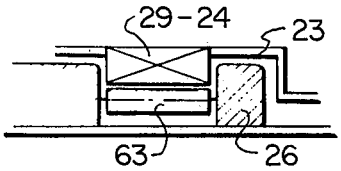
FIG. 8*d* is a partial sectional elevational view of the wedges used to retain the vehicles as shown in FIG. 8.
Figure 9:
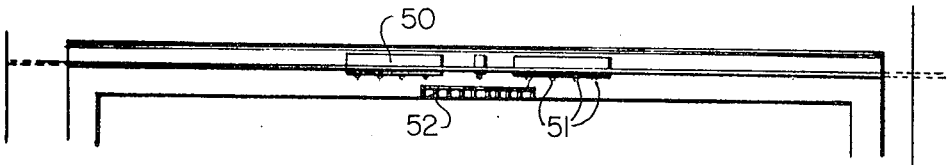
FIG. 9 is an enlarged elevational view of an area of the roof of the underground parking system indicated in FIG. 2, and corresponding transversally to the area indicated in FIG. 4.

It should be indicated that the telescopic arms will be supported, when they extend, on freely rotating rollers 30, as shown in FIG. 8*c*.

Withdrawal of a vehicle deposited on any level or floor of a tower (upper portion of FIG. 8*a*) will be carried out by activating the telescopic arms in the reverse order to the sequence described above, starting with an electric impulse or signal emitted by the control or programming center and received in zones 21.

The mechanisms discussed above for introducing the vehicles into the towers by their leading edge, may be used both in parking lots having accesses through ramps, as well as mechanical accesses, i.e. cargo hoist units. Also, the mechanism discussed with reference to FIGS. 8 and 8*a* may be used to introduce a vehicle from an entrance to a cargo hoist unit.

Figure 6A:
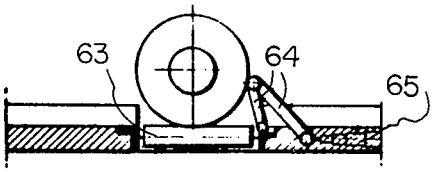
FIG. 6*a* and 6*b* represent enlarged details of FIG. 6 showing respectively the abutment of limiting device of the front wheels of a vehicle transversally entering the column, and the blocking device of the back wheels of the same vehicle.

Lateral introduction of vehicles, FIGS. 5 and 6, is carried out by means similar to those already mentioned. In effect, the vehicle, which should enter laterally or sideways, is previously deposited on a platform having freely rotating rollers 63, the axes thereof extending in the direction of the longitudinal axis of the vehicle, whereby the vehicle can be pushed laterally, i.e. sideways, sliding on rollers 63. Alignment of the vehicle is achieved, in the case of lateral entrance, when the front wheels of the vehicle rest on one of the legs of a compass shaped element 64 (FIG. 6*a*), at which moment a small telescopic arm 65 is extended which limits advance of the vehicle. The vehicle is then ready to be pushed laterally towards the tower, or to the cargo hoist unit.

When telescopic arm 15 of FIG. 6, which pushes the vehicle towards the tower or cargo hoist unit, returns towards its initial position, it pulls portion of a chain 31 (FIG. 6*a*) which rotates on a pulley 32, so that the pressure of a spring 33, which constantly pulls from the block crossbar 34 due to the fact that one end of spring 33 is fixed to the tower or cargo hoist unit, will be overcome.

Figure 6B:
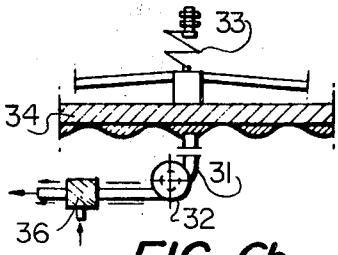
Figure 6C:
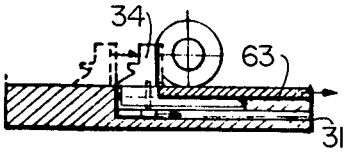
FIG. 6*c* is a sectional elevational view of the device of FIG. 6*b;*

Crossbar 34 then advances, sliding along rails embedded in the floor of the tower, until such crossbar 34 butts against the back wheels of the vehicle, thus locking a mechanism 36 which can be a latch or bolt which enters a corresponding link of the branch of chain 31. The direction of movement of the hauling chain of crossbar 34 is that indicated by the arrows in FIG. 6. When the latch 36 is released, the force of spring 33 pulls the crossbar 34 towards its initial position. The lower part of crossbar 34 (FIG. 6*b*) has undulations or grooves which match the roller arrangements existing on the floor of the tower. Such rollers are similar to those existing in zone 63, thus permitting the vehicle to slide laterally, i.e. sideways, when entering or leaving the tower. Blocking of the front wheels of a vehicle which enters laterally, is effected when the front wheels contact fixed wedges existing in the floor of the column. Such fixed wedges are reached by the front wheels of the vehicle when the same is moved forwards by crossbar 34, before such crossbar blocks the back wheels of the vehicle.

Once the vehicle is inside the tower movement of the tower towards any of the following points will be programmed:

1. Assuming that the vehicle admitted corresponds to an even numbered level, the column may be sent to a series of uneven numbered levels to receive other vehicles, when dealing with a parking lot having accesses by means of ramps, FIGS. 1 and 2.

Figure 4:
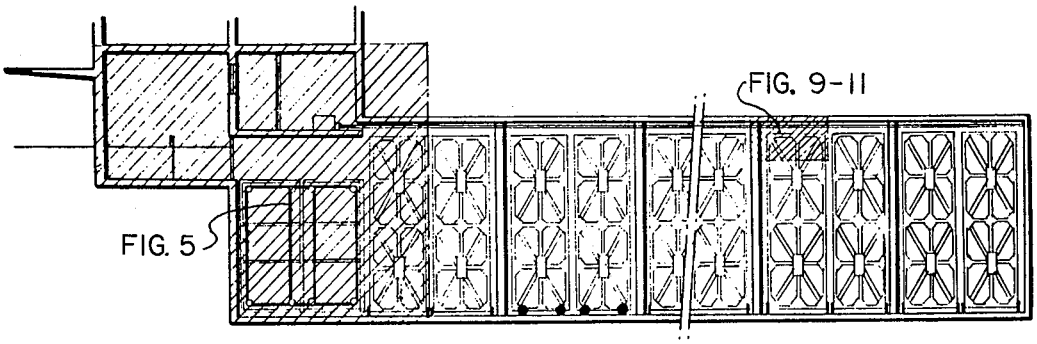
FIG. 4 is a longitudinal section of the parking system illustrated in FIG. 3, wherein the smaller surfaces of the towers are represented, due to their position perpendicular to that illustrated in FIG. 2.

2. The tower can be moved towards a nearby or immediate waiting area, to permit the arrival of another tower containing a vehicle to be withdrawn from the parking lot. This happens in a parking lot having ramps (FIGS. 1 and 2) or having cargo hoist units (FIGS. 3 and 4).

3. The tower can be directed towards the tower parking areas.

The mechanisms which control the movement of the towers, insofar as advance thereof in any direction is concerned, the braking of the towers and the turning of the wheels of the towers in a horizontal plane, act in response to electric impulses and will function at the first impulse, and will stop functioning at the second impulse received. Thus, displacement of a tower generally from for example position 1 to position 4 of a given lane, would be effected by activating the contacting devices for the movement of the tower, and by braking such tower at position 1, and by dismounting the same at position 4. If, on the contrary, the tower is to be moved from position 4 to position 1, the contacting device will be activated at position 4 and will be disconnected at position 1. Thus, with the same hauling or traction system various towers can be moved simultaneously and in different directions, as coupling of the towers to one or the other of pairs of tranction chains is produced.

The motors which move the tower hauling endless chains or cables will be situated in galleries or passages located at one side of the underground parking area and, preferably, in the bottom of such parking area.

Such motors, if movable, may be installed on traveling cranes, which are controlled by the electronic computer so that displacement of the traveling cranes is effected by supporting them on rails hung at a suitable height. When a traveling crane reaches the site where movement of the tower hauling systems is to take place, the motor bearing such traveling crane will be moved until its drive shaft is coupled to the corresponding steering wheel, which movement consequently, produces movements of the tower hauling system, for example, endless chains or cables.

Impulses for movement of a tower are provided by contact panels situated in the roof of the underground parking, as can be seen in FIGS. 9 to 12, and their specific task is to transmit electric current to the contacting and braking mechanisms. These contact panels are referenced 50 and are units having various electrical contacts 51 which, due to their combination with other units, fulfil the task of transmitting electric current to inducing plates 52 positioned on the roof of each tower.

Such inducing plates 52 are metallic plates which pick up the electric current and send such current to the corresponding tower braking mechanisms and to the devices 53 (contacting devices) which couple the towers to the traction chains.

Figure 10:
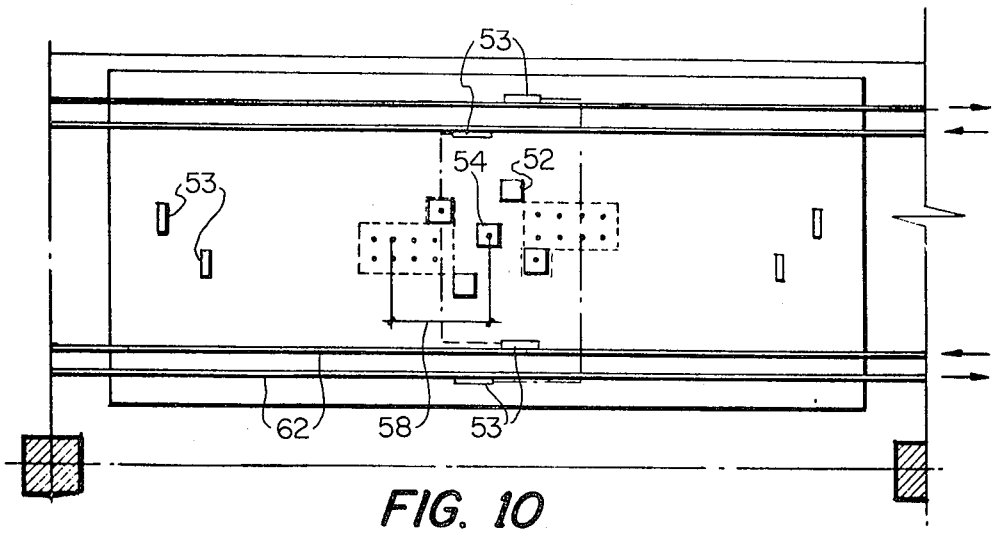
FIG. 10 is an upper plan view of the roof of a tower and a projection of the contact panels of the roof of the underground parking system shown in FIG. 9.
Figure 11:
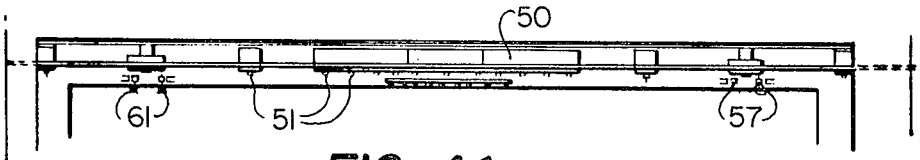
FIG. 11 is a view similar to that of FIG. 9, of an area of the roof of the underground parking system wherein the intersecting directions of the column hauling means (chains or cables) exist.
Figure 12:
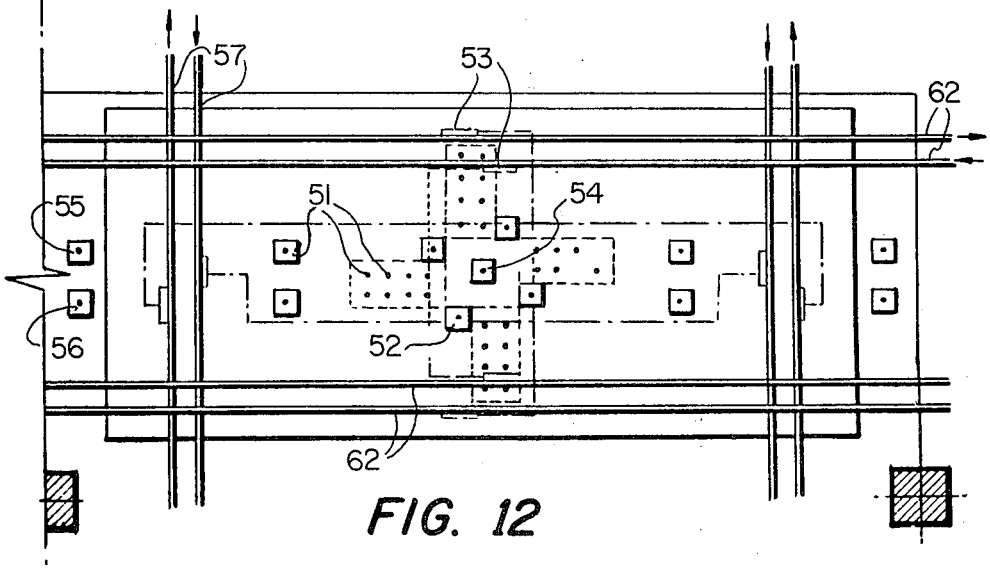
FIG. 12 is a plan view of the roof of a tower situated at a position of intersecting movement directions, the projection of the contact panels in the roof of the underground parking system, existing in such intersecting area, also being represented.

Inducing plates 52 are situated on the upper part of each tower and are aligned, as can be seen in FIGS. 10 and 12, in set of fives: four of which activate the contacting devices 53 and one, 54 which is centrally situated with respect to the other four and which brakes the tower. This distribution, represented in FIGS. 10 and 12, avoids the possibility of passing current from a contact 51 of panel 50 in the roof of the underground parking area through which a tower, other than the programmed one, passes. Contacts 51 form contact panels 50 in the roof of the underground parking area and, individually, each contact 51 forms a specific contact, such as those referenced 55 and 56, which supplement the four panels existing in the intersecting areas which permit passage, by inertia, of the chains of the series 57 and which specific contacts 55 and 56 will be situated at a suitable distance from the center of the intersecting plates, as can be seen in FIG. 12. Contacts 51 which form panels 50 are arranged in two rows, as can be seen in FIGS. 10 and 12. Activation of contacts 51, pertaining to the braking row corresponding to the braking plates 54, coordinate with the activation of the contacts pertaining to the contacting row of the devices for coupling the tower to the traction chains. Thus, the contacts of these two rows are paired and are separated from each other as determined by the braking parameters.

Standardization of the measurements of contact panels 50 of the roof of the underground parking area and of the inducing plates 52 and 54 of each tower will be the result of the dimensions of a given system.

The contact devices are used to couple the towers to the traction chains or to uncouple the same therefrom. Eight contacting devices 53 in FIG. 12 are situated in the upper part of each tower. Four of these contacting devices 53 operate for each perpendicular plane of movement of the tower, two for each direction. These contacting devices 53 are placed at two different heights (60 and 61 in FIG. 17*a*), depending upon whether they should act on the chains of the series 57 or series 62 (see FIGS. 10, 12 and 17). The purpose of this is to overcome the difference in height of the two traction chain systems 57 and 62, using a standard contacting device for the two systems. These contacting devices can be electrically or hydraulically activated, although activation by means of electricity is preferred.

The tower traction chain systems 57 and 62 will move continuously. When a tower is to be displaced, electric current is sent to the contacts 51 which act on the pair of contacting devices corresponding to such contacts. The electric current which passes through contact 51 to inducing plate 52 of the roof of the tower, feeds coil 66 contact device 53, producing movement of a disc 67 from position 1*a* to position 2*c*. Disc 67 forms a solid part of shaft 68 which is in turn solidly fixed to a disc 69 which restricts or controls spring 70. In the casing of spring 70 there is a breaker, for example a ball breaker 71, which causes closure of the circuit of another coil 72 having an armature disc 73 which was in position 1*b* and is now moved to position 2*b*. Connected to shaft 68 of coil 66 is a lever 74 which rotates around a shaft 75. The free end of lever 74 will be coupled to a hauling element 76 which forms part of the corresponding traction chain 57. This is due to the fact that the opposite end of lever 74 is joined to shaft 68 of coil 66. Thus, shaft 68 will be in contacting position and coupling of lever 74 to hauling element 76 of chain 57 will then cause movement of the tower, bearing in mind that there is a device, such as that described, for each traction chain. This movement of the tower causes separation of contact 51 of the panel of the roof of the underground parking area from the plate 52 of the roof of the tower, thus disconnecting coil 66, and consequently spring 70 pushes disc 69 from position 2*a* to 3*a*, whereat the same is maintained by the core of auxiliary coil 72. In order to disconnect coil 66, current will again be sent to other contacts 51 of a different panel of the roof of the underground parking area, whereby the process is repeated. Disc 69 now passes from position 3*a* to 2*a*, while the disc of coil 72 passes from position 2*b* to 1*b*. Since contact 51 no longer makes contact with 52 due to the effect of spring 70, disc 69 passes from position 3*a* to 1*a*, lever 74 being uncoupled from chain 57. This system need not withstand the hauling forces F nor the rotation forces on 75, since both components will act on shaft 75, thus avoiding their impact on the core of the coil 72. That is, force F cancels the effect of the positive rotation, and the negative rotation is cancelled due to the displacement of spring 70 along distance K.

Figure 13:
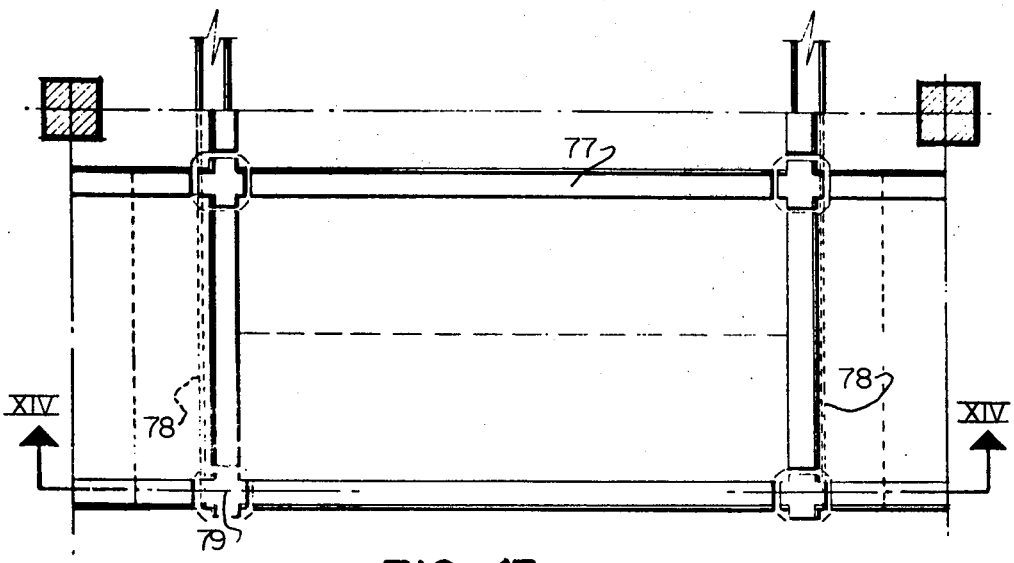
FIG. 13 is a plan view of an area of the floor of the underground parking area wherein the tower sliding tracks intersect, showing the mechanisms for turning the wheels of the towers in a horizontal plane.
Figure 14:
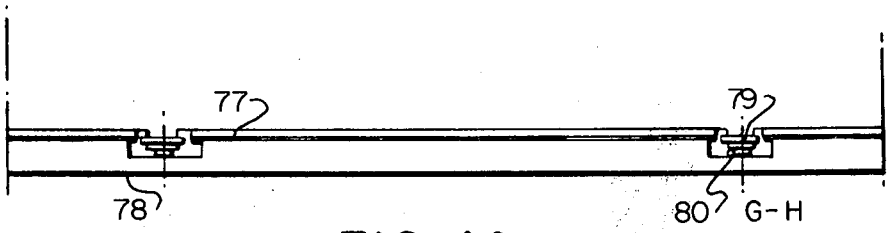
FIG. 14 is a section taken along lines XIV—XIV of FIG. 13.
Figure 15:
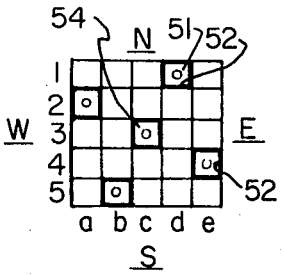
FIG. 15 is a functional diagram of the braking and/or turning phase of the wheels of a tower, by activation of the contacts in the roof of the tower on the contacts of the panels in the roof of the underground parking system.
Figure 16:
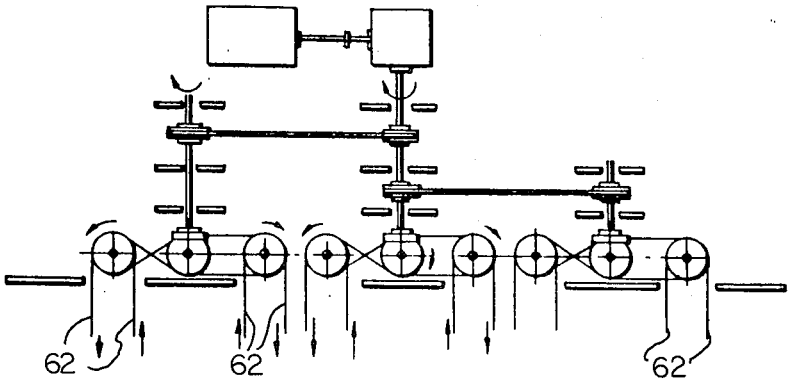
FIG. 16 is a functional diagram of an endless transmission system for hauling or pulling the towers, this figure being an enlarged detail of the stripped zone shown in FIGS. 1 and 3.
Figure 17A:
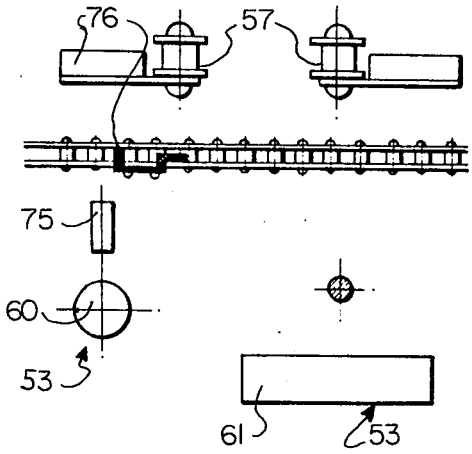
FIG. 17*a* is a schematic view showing the positions of the elements represented in FIG. 17.
Figure 17:
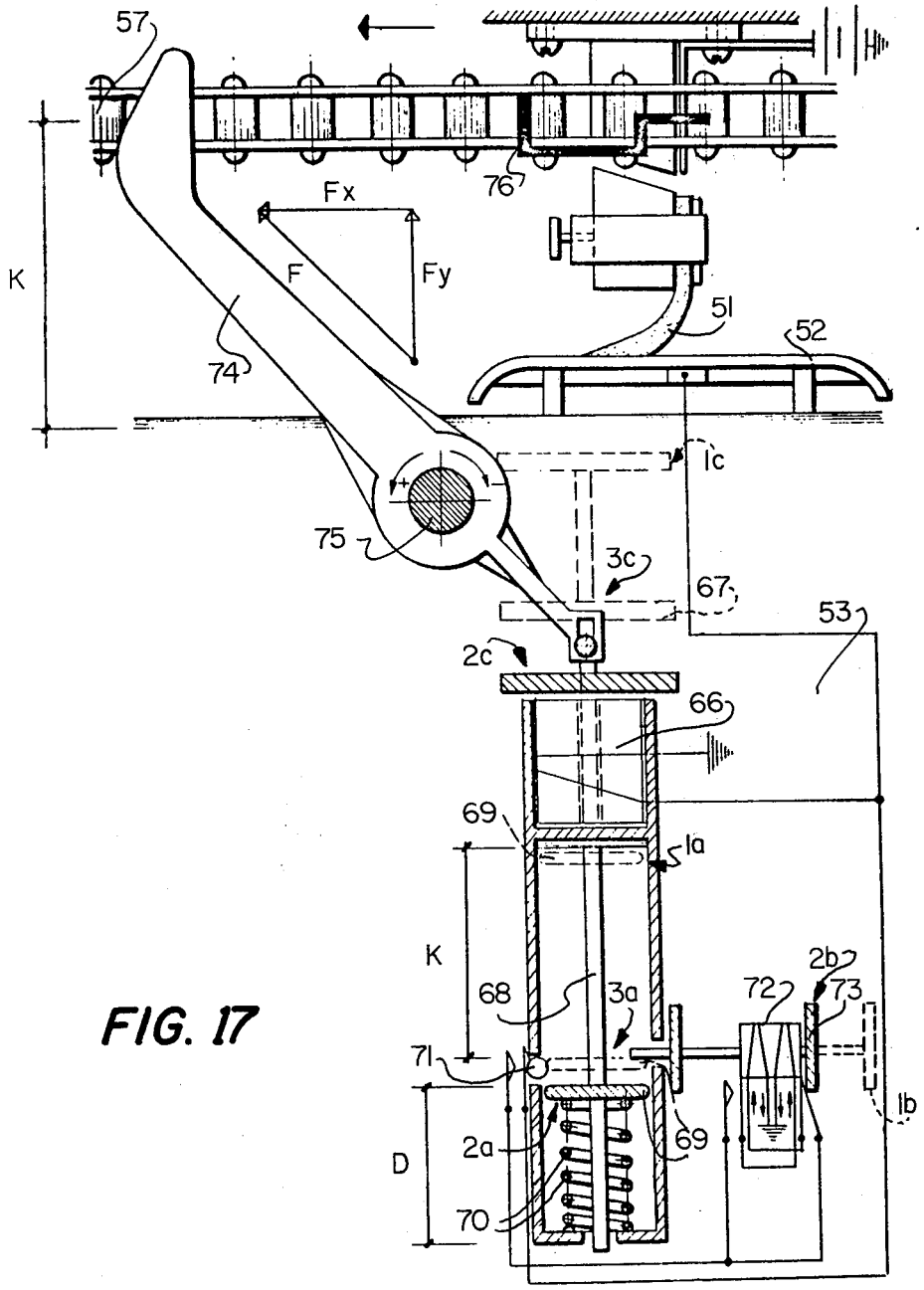
FIG. 17 is a functional diagram of the device for coupling and uncoupling the tower with the hauling system, specifically represented as a chain.

The floor of the underground parking area has tracks 77, formed by metallic profiles as shown in FIGS. 13 and 14, which can be similar to the railroad rails. Tracks 77 are embedded in the floor of the underground parking area. Besides tracks 77, there are rotation chain 78 systems in the floor of the underground parking area. These rotation chains are positioned in the service lanes 1 and 5 of series L in FIG. 1.

When the tracks of the service lanes intersect with the tracks of the tower parking lanes, squares are formed. Intersection of these tracks represent turning zones within a horizontal plane for the wheels of the columns. Such zones have therein rotating crossheads 79 shown in FIG. 13. Each rotating crosshead 79 is mounted on a device 80 which is activated by the rotating chain 78. The rotation given to each crosshead 79 will be 90° in either direction, thus causing the wheels on the bottom of the tower to turn in a horizontal plane.

Motors situated in passages of the sides of the underground parking area, which move the rotating chains 78, will generally move continuously, thus turning the rotating chains 78 to which the rotating devices 80 of the respective crossheads 79 will be solidly fixed, when a tower passes over crossheads 79.

Should the tower not receive the signal to stop on top of the crossheads, turning of such crossheads will not be effected due to the fact that each crosshead 79 will not be engaged with the device 80, which thus turns without pulling crosshead 79. Rotation of device 80, when a tower passes thereover, whether stopping or not, is produced due to the fact that the weight of the tower pushes the assembly of the crosshead 79 and device 80 downwards. At this moment the device 80 is connected to chain 78 and such device 80 turns, without pulling crosshead 79. When the tower continues to press downwardly due to the effect of the tower stopping on the crosshead, device 80 does not cease turning and thus reaches a point whereat it is attached to the lower part of crosshead 79, thus forcing crosshead 79 to turn. Thus, the wheels of the tower will also turn, in a horizontal plane, within a previously calculated angle of 90°. At this moment the tower will receive a signal to resume movement, and will thus leave crosshead 79 of the ihntersection of tracks on which it had stopped, or alternatively the device 80 stops rotating crosshead 79.

Adjacent the positions of access of the vehicles to the towers there are scales, such as 59 shown in FIG. 8*a*, which scales 59 will permit the weight of each tower to be verified, due to the number of vehicles introduced therein, in order to be able to conveniently program the braking of the tower, sending a signal to the braking contact 51 of the contact panel 50 in the roof of the underground parking area which will be activated.

Braking of the wheels of the tower can be effected by any known type of suitable hydraulic or electrical means. In both cases, when the movement of a tower situated on scales 59 is programmed, the weight of such tower is used to send current to the braking contact of the panel situated in the site towards which the tower is directed, which will precisely be that where such tower is detained, either to remain parked or so that its wheels are turned. The parking period, i.e. distance 58 in FIG. 19, will be adequate to effect the complete braking of the tower. For the same purpose contacts 51, which form the braking row, are connected in such a way that if the third braking contact is connected, the third, second and first contacts will have current.

To avoid collision of a tower which is braked, in order to rotate its wheels and to introduce such tower perpendicularly to the direction in which it had been moving, with another tower immediately behind the same, the maximum rotating time of the wheels and introduction of the tower in the other direction and, consequently, the distance of hauling element 76 of chain 57 in a sufficient period of time, must be properly calculated. This distance will differ in systems 57 and in system 62.

Hauling of the towers will be effected at the upper part thereof and will be carried out by means of a special chain system. The hauling system is formed by two endless chains for each direction, thus forming four lines, two for each direction, in such a way that movement of these chains will be in the same direction of travel, at the same distance to the tower or displacement thereof (see FIG. 12). The hauling chains of one direction will intersect, in specific zones, with the traction chains of the perpendicular direction, wherefor the chains 57 for movement in directions A will be at a level different from chains 62 for movement in directions L. Preferably, the traction chains parallel to the longitudinal axis of the tower will always be at a higher level than the traction chains parallel to the transversal axis of the towers.

Function and stoppage of the traction chains for a given tower will be explained in the following:

1. The following study is based on the assumption that the tower has the minimum weight, i.e. it does not house all the vehicles of which it is capable of holding, and the electric current is thus always directed to the last contact 51 provided therefor, see FIG. 15 which shows the inducing plates of the roof of the tower, which plates coincide with the last contacts of the panels existing in an intersecting zone, according to FIG. 12.

With reference to FIG. 12 it should be assumed that the tower is detained and in FIG. 13 that turning is to be initiated.

2. The inducing contacts are considered in a pattern resembling a chess board having vertical coordinates 1, 2, 3, 4, and 5 and horizontal coordinates *a, b, c, d* and *e*, the inducing contacts occuping the following positions:

2*a* - Contacting plate for the movement L+
4*e* - Contacting plate for the movement L−
1*d* - Contacting plate for the movement A+
5*b* - Contacting plate for the movement A−
3*c* - Brake contacting plate

3.

+ sign S to N direction for series A.57 in FIG. 12
+ sign E to W direction for series L.62 in FIG. 12
− sign N to S direction for series A.57 in FIG. 12
− sign W to E direction for series L.62 in FIG. 12

Now will be considered the contacting and disconnecting operations for movement in the 62 (+) direction.

1. Current is fed to 3*c*, cancelling braking;

2. Current is fed to 2*a* contacting the coil for 62(+); from this point movement of the tower, which will intersect moving chains 57 A by means of the contacts of the panels in the roof of the underground parking, is produced;

3. A signal is emitted to disconnect the coil for 62(+), thus the disconnecting signal should precede that of braking. The current is then fed to contact 2*e;*

4. Braking signal, feeding current to contact 3*e*.

Contacting and disconnecting during movement 62 (+)

1. Current to 3*c* = cancellation of braking.
2. Current to 2*a* = coil 62 (+) is contacted.
3. Current to 2*e* = contact of 51 with 2*e* = disconnecting 62(+).
4. Current to 3*e* = contact of 54 with 3*e* = braking.

Contacting and disconnecting during movement 62 (−)

1. Current to 3*c* = cancellation of braking.
2. Current to 4*e* = contacting of coil 62 (−).
3. Current to 4*a* = contact 51 with 4*a* = disconnecting L−.
4. Current to 3*a* = contact of 54 with 3*a* = braking.

CONTACTING AND DISCONNECTING DURING MOVEMENT 57 (+)

1. Current to 3*c* = cancellation of braking.
2. Current to 1*d* = contacting of coil 57 (+).
3. Current to 5*d* = contact of 51 with 5*d* = disconnecting A+.
4. Current to 5*c* = contact of 54 with 5*c* = braking.

CONTACTING AND DISCONNECTING DURING MOVEMENT 57 (−)

1. Current to 3*c* = cancellation of braking.
2. Current 5*b* = contacting of 57 (−).
3. Current to 1*b* = contact of 51 with 1*b* = disconnecting A.
4. Current to 1*c* = contact of 54 with 1*c* = braking.

In a parking lot according to the embodiment of FIG. 1, the vehicle will always enter the tower by its leading edge, and therefore when the vehicle is to be withdrawn, it is necessary to rotate the tower by 180°. This rotation of the towers is effected on revolving platforms situtated on the floor of the underground parking area in squares 1*a*/1 and 1*b*/1, see FIG. 1.

Such platforms are activated by a motor. The electronic computer will be programmed to memorize the towers which are rotated as well as those which are not rotated, i.e. those which do not require rotation in order to return the vehicle by its leading edge, or those which should effect such rotating movement only when it is imperative, this fact being borne in mind by the electronic computer, when a tower to receive more vehicles is selected.

It is also possible for the lower zone of the lowest level of the tower to be provided with a projection, which projection when the tower is directed to the exit to deliver a requested vehicle and the electronic computer has prepared the rotating motor circuit of the platform would then act in such a way that the feeding circuit will be closed if the projection of the tower arrives at the appropriate side, i.e. if the tower has not previously been turned.

With reference now to FIGS. 18 to 28, a second embodiment of the invention will be described.

Figure 18:
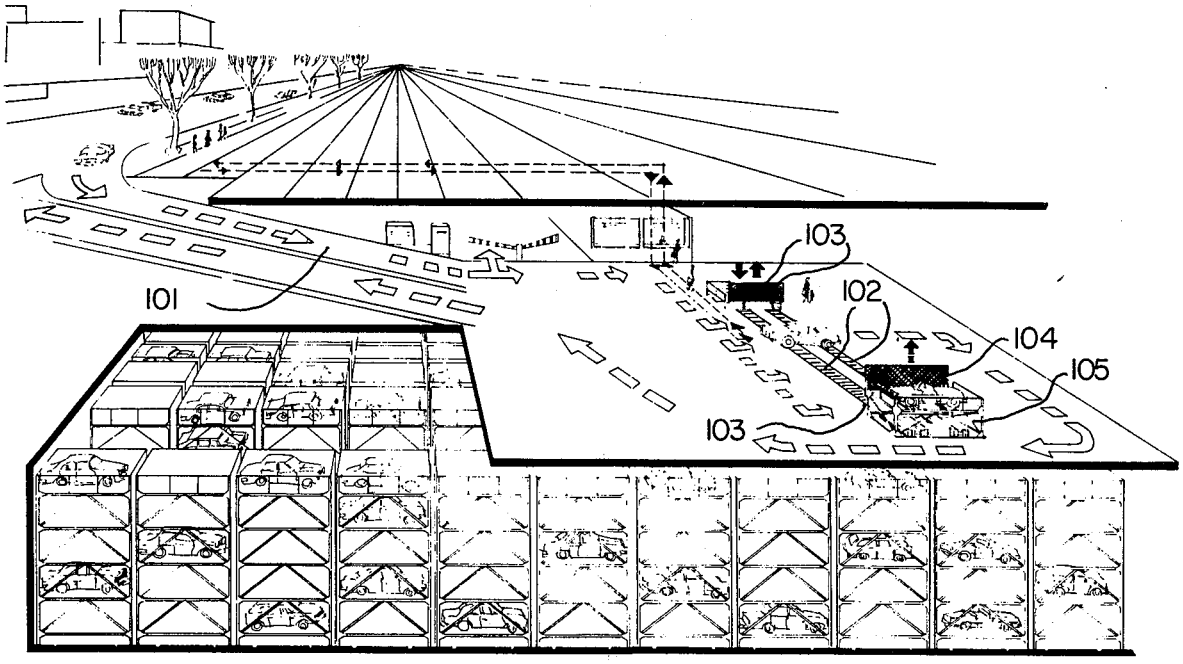
FIG. 18 is a partially sectioned perspective view of an automatic underground parking system according to a second embodiment of the present invention.

FIG. 18 illustrates how a vehicle which has entered the parking lot through ramp 101 is abandoned by its occupants when the driver has positioned the vehicle in an area wherein there is a pair of endless belts 102. The operator, or person in charge of the parking lot, will then start the automatic collection cycle of the vehicle. For such purpose, the endless belts 102, on which the front and back wheels of the vehicle are supported, will firstly be activated. The vehicle with thus be displaced in a direction perpendicular to the normal direction of travel of the vehicle.

The vehicle will be deposited by the belts 102 in zones 103 comprised of parallel laths or bars which are separated from each other, and on which the wheels of the vehicle will now be supported.

The barrier 104 will then immediately be raised. Such barrier can optionally be provided in a cargo hoist unit 105.

Any one of the floors of cargo hoist unit 105, since it can have various floors, will be aligned with or at the same level as the lath zone 103 on which the vehicles rests.

The cargo hoist unit 105 is slidably mounted, in an upwards and downwards vertical direction, along guides 106. Such guides are provided with pivots 107 with which shafts 108, moved in unison by an electromotor 109 from which shaft transmission devices 110 are transmitted to shafts 108, permanently mesh. Motor 109 will be coupled to an electrobrake. This structure is known, and therefore it is to be understood that any other type of suitable cargo hoist unit could be used.

Figure 21:
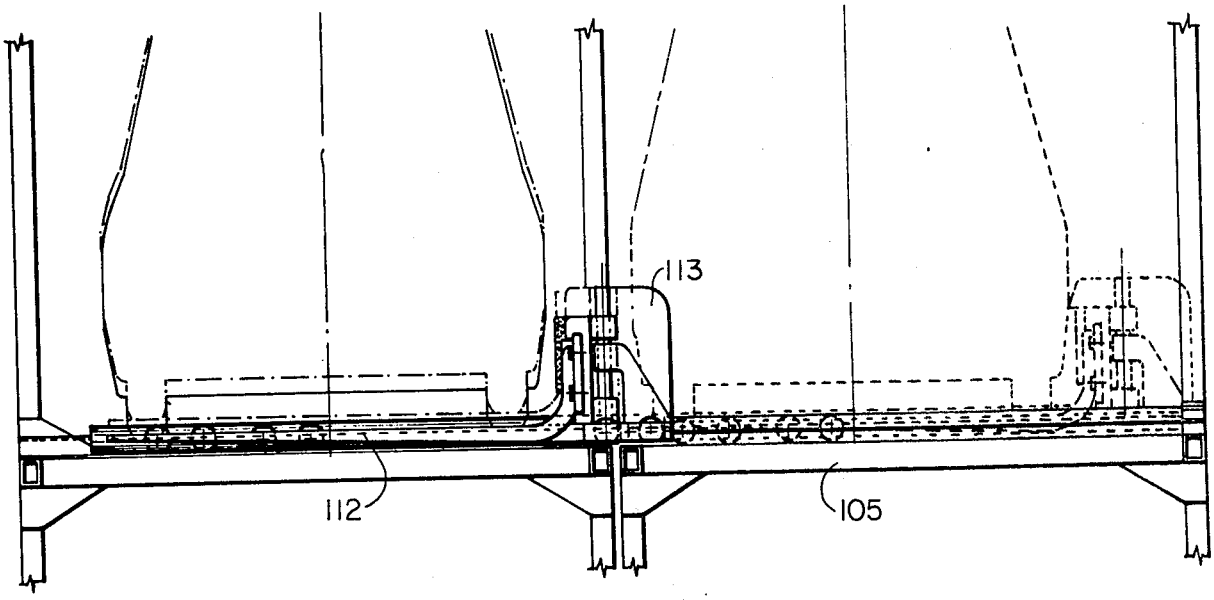
FIG. 21 is a side elevational view of the cargo hoist unit attached to a tower, at the time of effecting the displacement from the cargo hoist unit to the tower.
Figure 22:
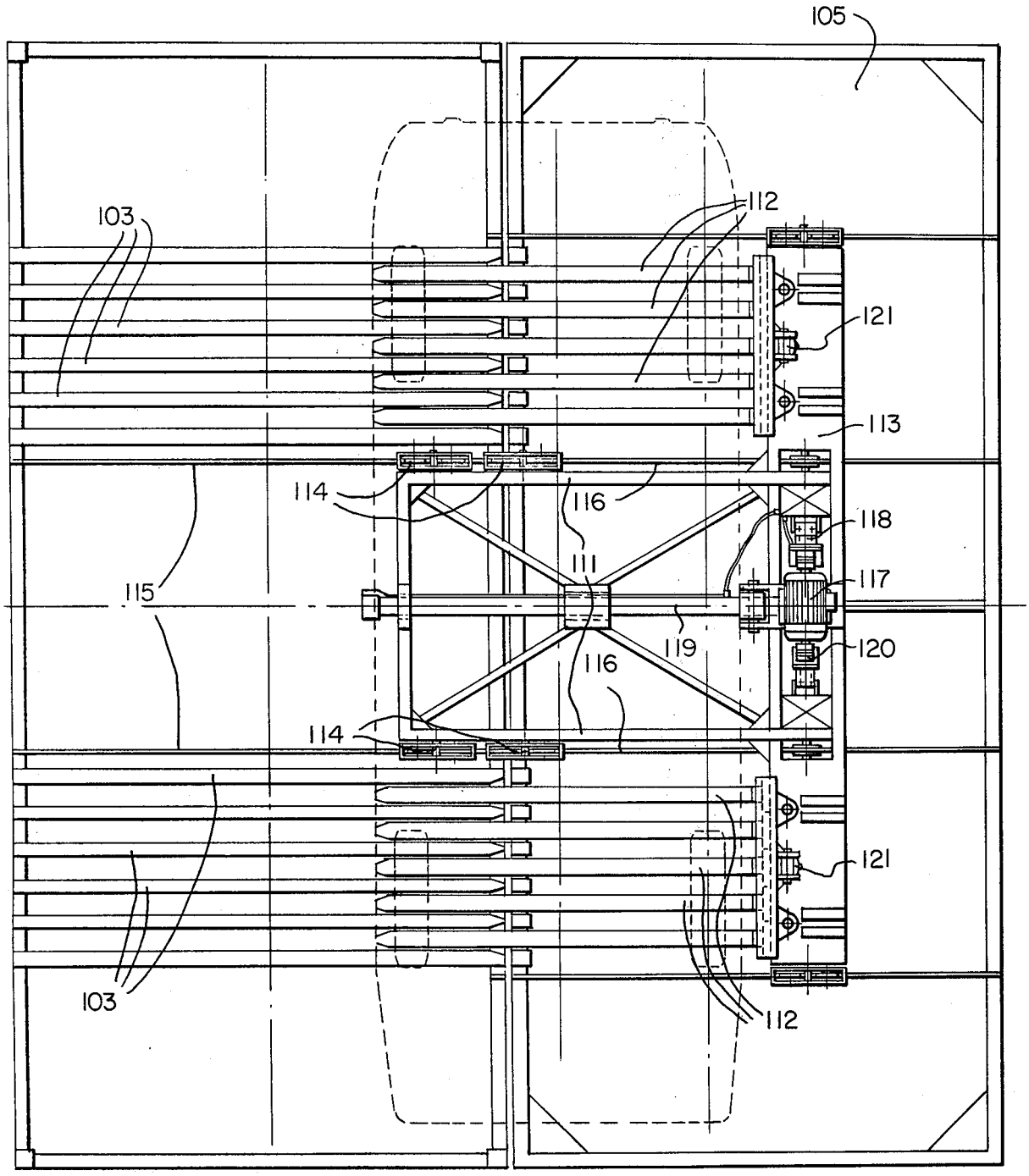
FIG. 22 is a plan view of that illustrated in FIG. 21.

Assuming that one of the floors of the cargo hoist unit 105 is already aligned with the lath zone or lathed flooring 103 whereon the vehicle is supported, the device structurally illustrated in FIGS. 21–23 will be operated.

Such device, which will be displaced from the cargo hoist unit, comprises a beam 113 which at its center is solidly fastened to a central frame 111, at both sides of which and connected to the beam 113 itself there are two shovels formed by groups of bars or flanges 112.

The bars or flanges 112 are separated from each other by a distance approximately equal to that which exists between adjacent laths of the zone 103, so that when the shovels leave the cargo hoist unit, flanges 112 can be introduced between the laths of zone 103.

Movement of the shovels into or out of the cargo hoist unit 105 is accompanied by the frame 111, which slides supporting wheels 114 with which it is provided in rails 116 of the floor of the cargo hoist unit, rails 116 being in alignment with other rails 115 existing in the lathed flooring 103.

It should be pointed out here that rails similar to those referenced 115 will also exist between the lathed zones of each floor of the towers.

Forward or return movement of the frame 111 and, consequently, of the shovels 112 is carried out by an electromotor 117 which activates a hydraulic pump 118, which pump imparts pressure to a telescopic arm 119.

The extendible end of arm 119 is fixed to the front cross-member of frame 111. When telescopic arm 119 is extended, shovels 112 will be displaced from the position of FIG. 23A, entering between the laths on which the wheels of the vehicle rest, as indicated by the position of FIG. 23B. It should be borne in mind here that although the cargo hoist unit 105 has been represented partially next to a tower (also represented partially), it should be assumed that a column could be the lathed zone 103 illustrated in FIG. 18. When the extension of arm 119 ends, an end of stroke mechanism will be activated which will activate another hydraulic pump 120. This pump imparts pressure to telescopic arms 121 which will raise shovels 112. Since the flanges of such shovels pass between the laths 103 (see FIG. 22), the vehicle will be raised to the position of FIG. 23C.

Figure 23A:
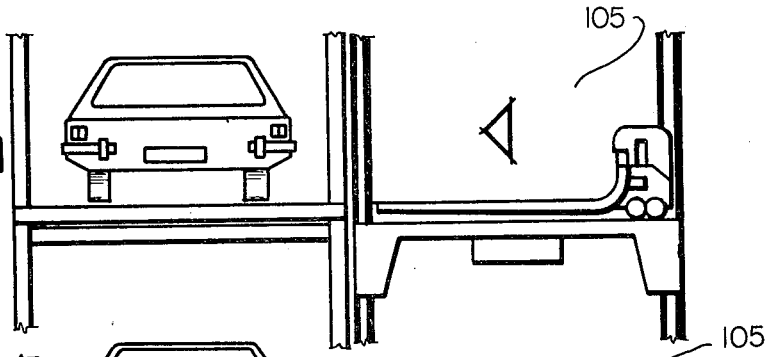
FIGS. 23A–23D are diagrammatic views illustrating the functioning of the vehicle displacing devices with respect to the cargo hoist unit. The different positions represented illustrate collection of a vehicle deposited in a tower to be displaced to the cargo hoist unit. It should be assumed that instead of a tower, the admission zone of vehicles into the entrance of the parking lot could have been represented, i.e. the zone in which the endless belts deposit the vehicle on the laths.
Figure 23B:
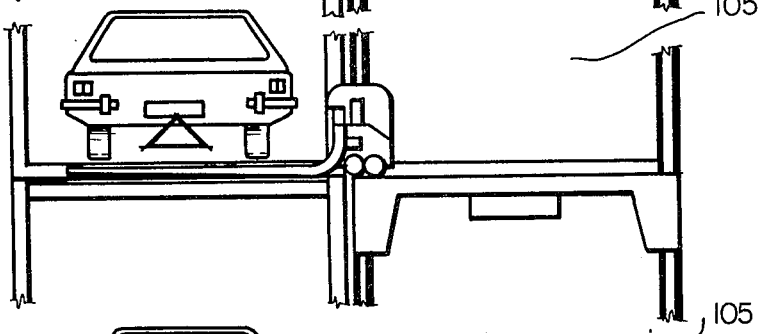
Figure 23C:
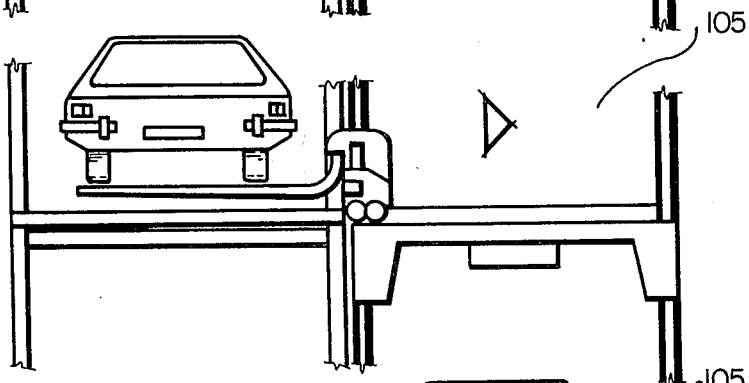
Figure 23D:
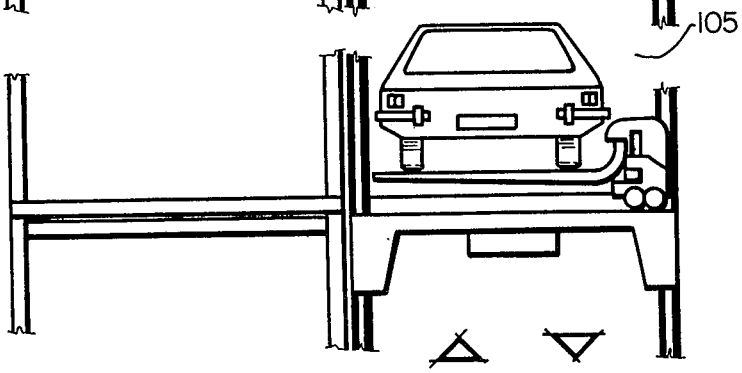
Figure 24:
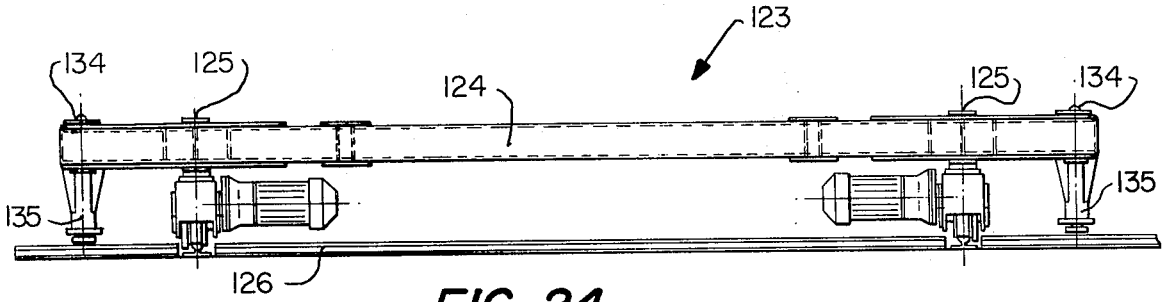
FIG. 24 is an elevational view of a power car along one of the larger sides thereof.

Once the vehicle is in the position of FIG. 23C, the path of travel of extendible arm 119 will be reversed, and thus the vehicle passes to the position of FIG. 23D, that is to say, into the cargo hoist unit 105.

Figure 19:
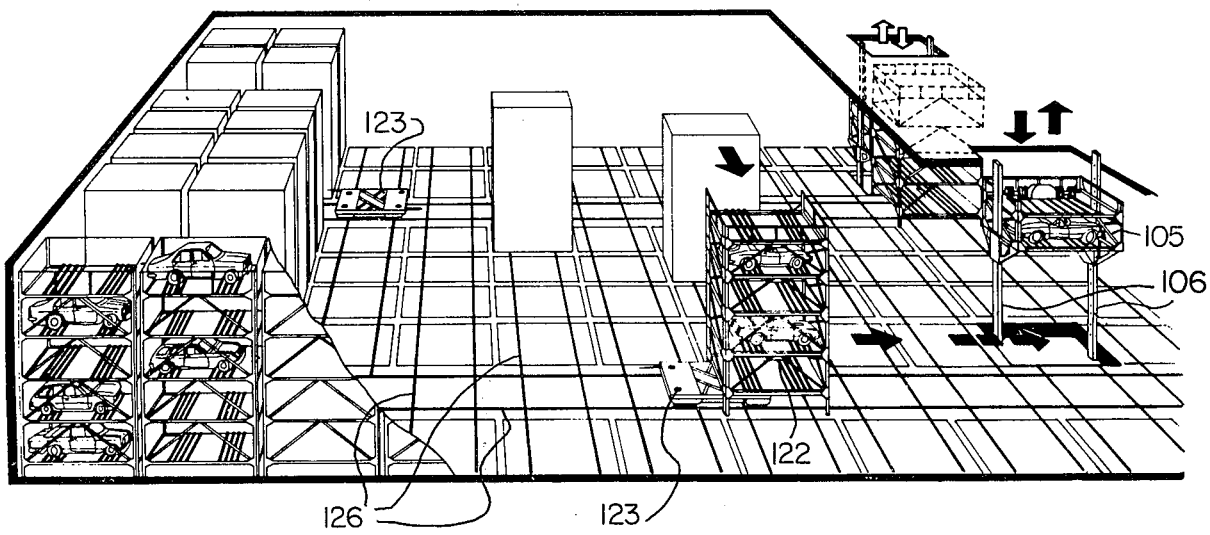
FIG. 19 is a perspective view of the underground parking area or space for storing of the towers in the system of FIG. 18.
Figure 20:
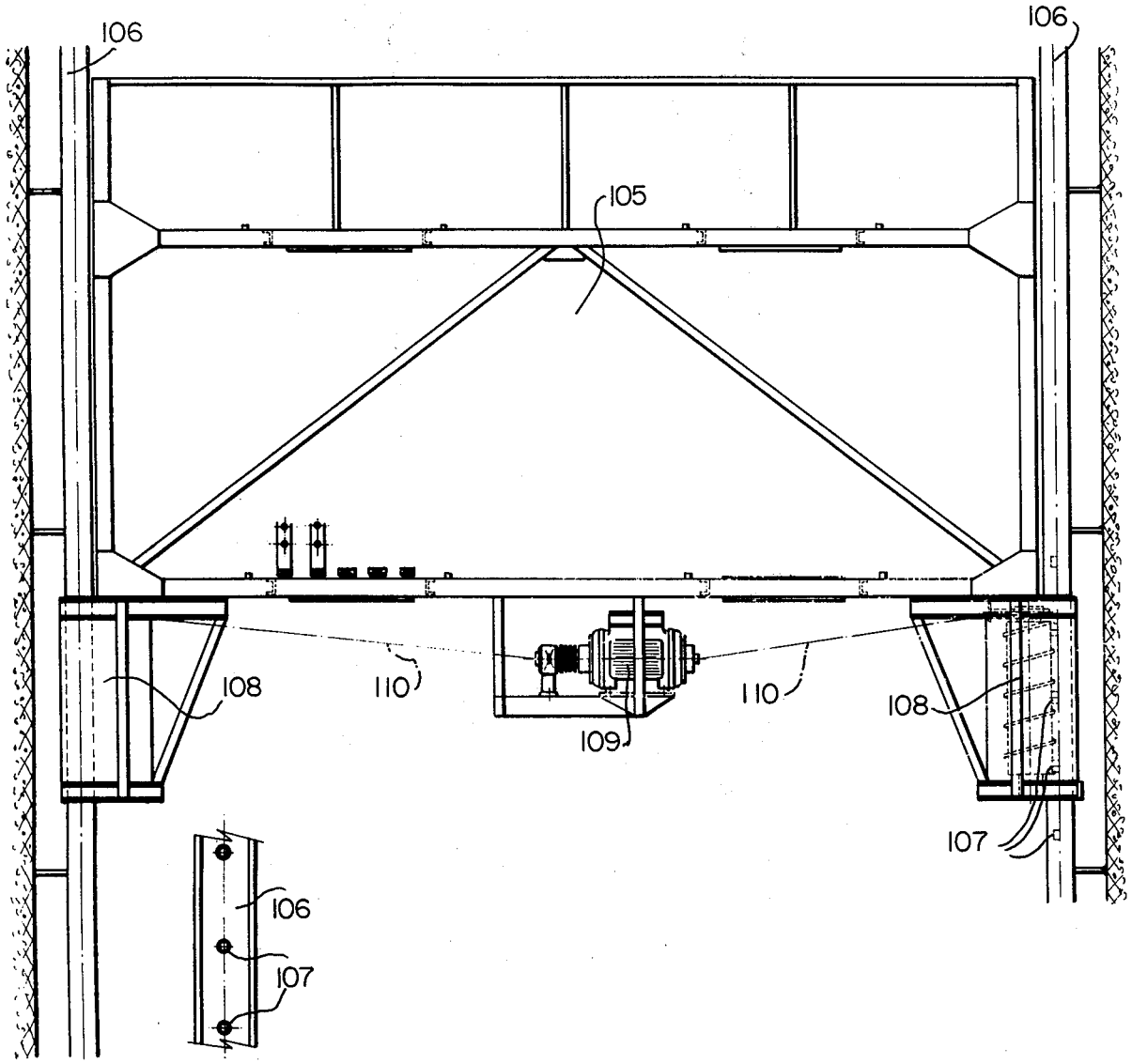
FIG. 20 is an elevational view of a cargo hoist unit used in the embodiment of FIG. 18.

The cargo hoist unit will immediately descend, see FIG. 19, carrying the vehicle on one of its floors. Meanwhile one of the towers 122 in FIG. 19 will have been displaced until it is situated next to the cargo hoist unit, so that once such cargo hoist unit 105 is in line with one of the free floors of the tower 122, the cycle represented in FIGS. 23A–23D will be repeated, although in a reverse sequence, that is to say from the position of FIG. 23D, wherein the vehicle is inside the cargo hoist unit 105, to the position of FIG. 23A, wherein the vehicle is outside the cargo hoist unit.

In the position of FIG. 23A, wherein the vehicle is already deposited in the tower 122, displacement of the tower by means of one of the power cars 123 will take place.

The structure of power cars 123 is illustrated in FIGS. 25 to 28.

Figure 25:
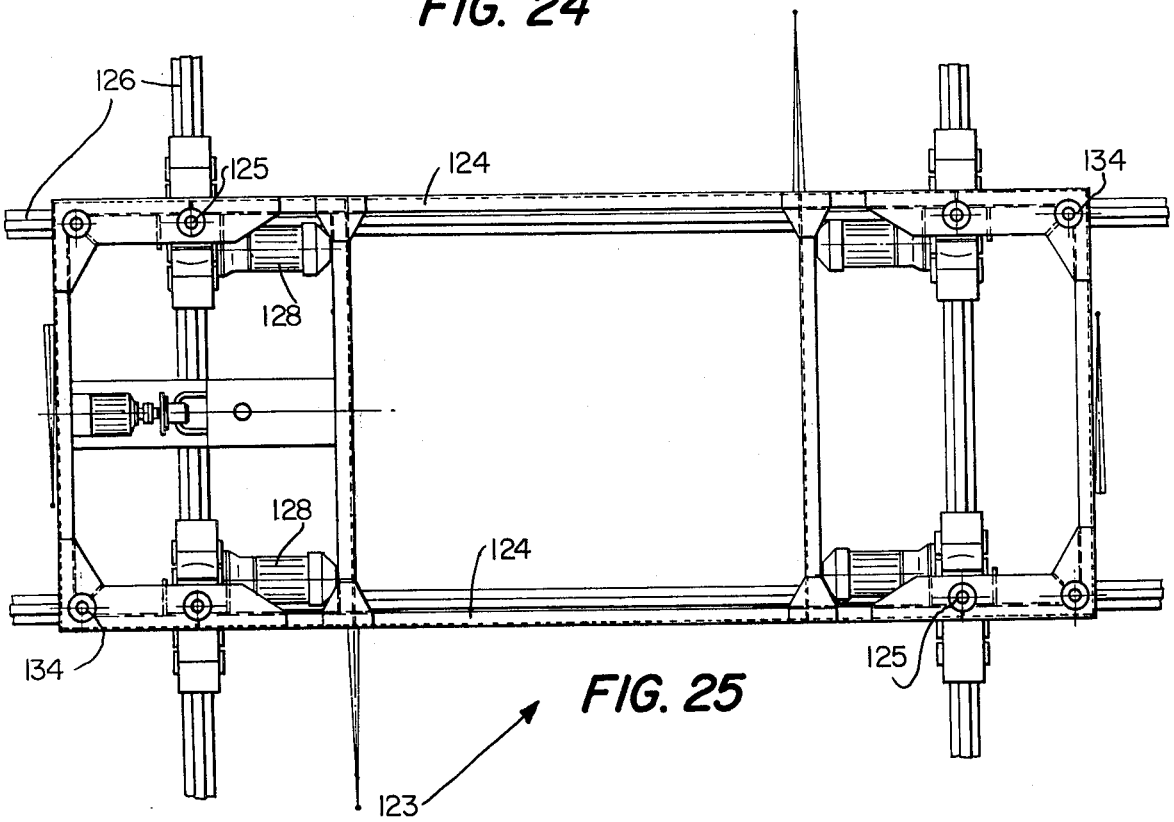
FIG. 25 is an upper plan view of the power car shown in FIG. 24.
Figure 26:
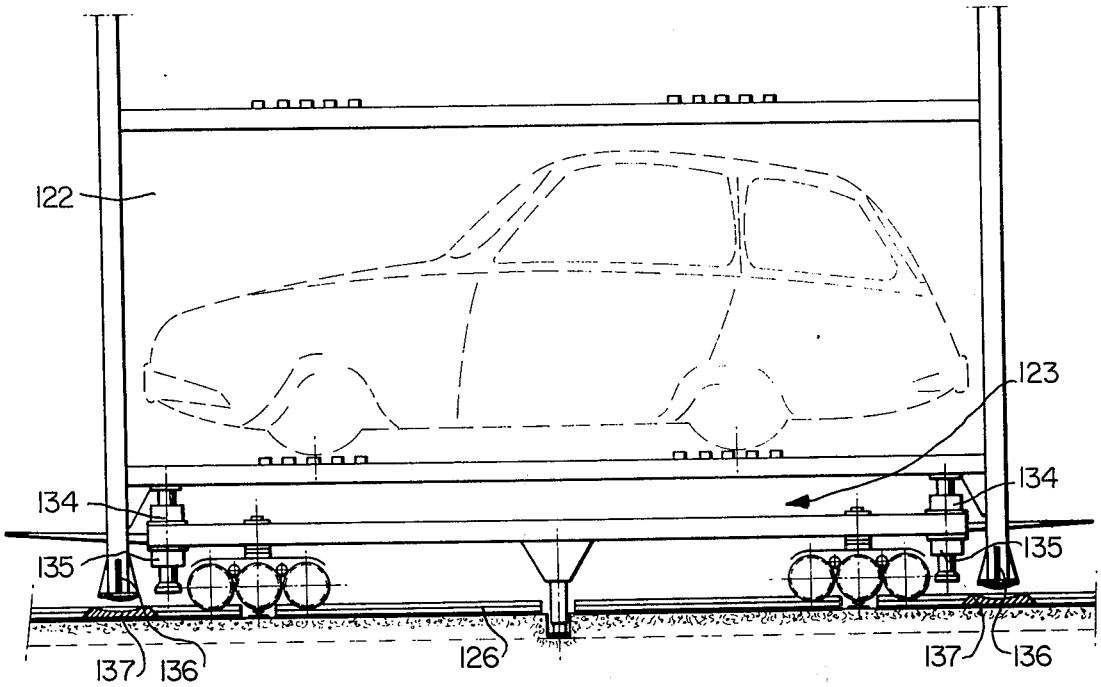
FIG. 26 is an elevational view of a power car positioned beneath a tower.

It can be seen from FIGS. 25 and 26 that the power cars are comprised of a rigid rectangular frame, in the side members 124 of which there are installed shafts 125 for wheel trucks 127 which, in fours, form the roller system for the power car on the rails 126 which form the network of the underground parking area, as shown in FIG. 19.

Figure 27:
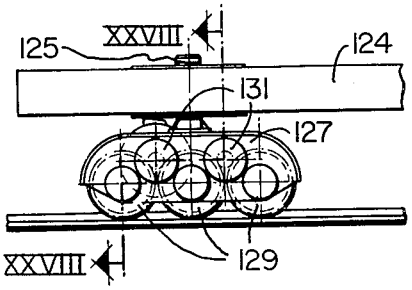
FIG. 27 is an enlarged elevational view of one of the trucks of a power car.
Figure 28:
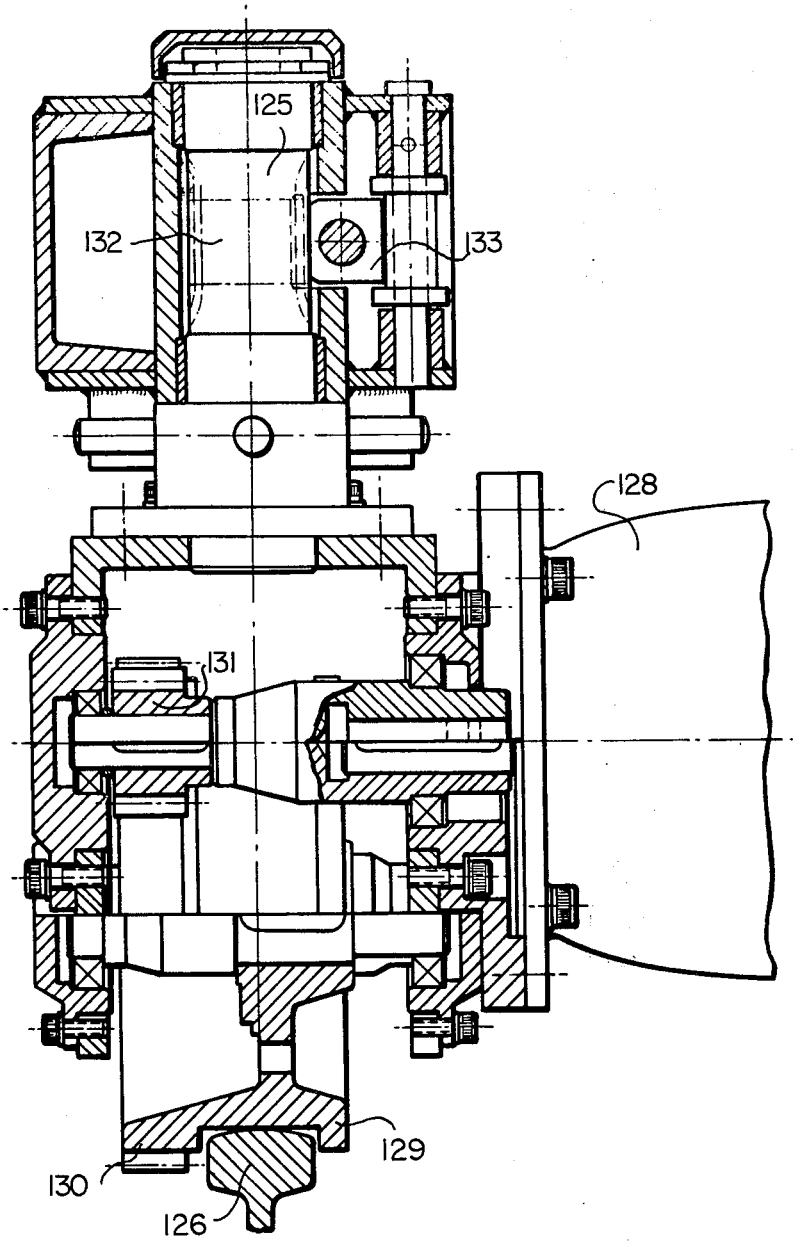
FIG. 28 is a sectional view of a truck, taken along lines XXVIII—XXVIII in FIG. 27.

Each one of trucks 127, as shown in FIG. 27, comprises three wheels 129, each one of which is solidly attached to a sproket 130 (see FIG. 28).

Between adjacent sprockets 130 and permanently meshed therewith are pinions 131 through which wheels 129 are rotated, since one of the pinions 131 is fixed to the shaft of an electromotor 128 (FIG. 28).

It is understood that each truck 127 has its own motor 128, as illustrated in FIG. 25.

It necessity for each truck 127 having three wheels 129 is due to the fact that in each crossing zone of the rails 126 such rails are cut. It is then necessary that at least two wheels 129, which will be the side wheels, be supported on the rails themselves. Thus, power is transmitted to the side wheels 129 through the central wheel 129 and auxiliary pinions 131.

The shaft 125 of each truck is formed with pinion teeth 132, with which a rack 133 meshes, see FIG. 28. Such rack can be displaced, for example, by means of a hydraulic cylinder, which is the system used to turn the trucks 90°, thus obtaining the perpendicular variation of the displacement of the power cars which travel along the rails 126. It can be seen that these changes of direction will be effected in those areas of the network wherein crossing of rails 126 exist.

There are provided eight hydraulic jacks, four of which 134 point upwards and four of which 135 point downwards, at the corners of the frame of the power cars.

The purpose of upper jacks 134, as shown in FIG. 26, is to raise the tower 122, when the power car 123 has been positioned exactly beneath the tower. Thus, the legs or supports 136 of the tower are lifted from contact with the flooring of the underground parking area, and the tower can then be displaced when the motors 128 of the trucks 127 are activated.

In the rectangular parking areas for the towers there may be provided elements 137, the upper surface of which is concave and wherein rounded ends of the legs 136 of each tower 122 may rest.

The lower hydraulic jacks 35 are provided for the purpose of raising the power car 123 so that the trucks 127, and more specifically the wheels 129 of such trucks, lose contact with the rails 126 and can be turned by means of the mechanism explained with relation to FIG. 28.

It should be pointed out that the lower jacks 135 should operate only when the upper jacks 134 are retracted.

The hydraulic system incorporated in each power car 123, to activate jacks 134 and 135, as well as to turn the shafts 125 of the trucks 127, will be so designed that they will guarantee the following operations:

1. The hydraulic cylinders which move the racks 133 will only operate when the power car is raised with respect to the rails 126, that is to say, when the lower jacks 135 are extended.

2. The upper jacks 134 can be extended only when the lower jacks 135 are retracted, and vice versa.

It is to be understood that various modifications could be made to the specific structural combinations described above, without departing from the spirit or scope of the invention.

For instance the vehicle parking system could employ the features of the first embodiment of FIGS. 1 to 17*a*, but with the cargo hoist unit and shovel structure of the embodiment of FIGS. 18 to 28. Similarly, the power car structure of the embodiment of FIGS. 18 to 28 could be employed in a parking system employing the cargo hoist unit structure of the embodiment of FIGS. 1 to 17*a*.

Still further, it should be understood that the contact system of the embodiment of FIGS. 1 to 17*a* for signalling starting and stopping of tower movement could be employed to start and stop motors 128 to initiate movement of the power cars in the embodiment of FIGS. 18 to 28.

It should very particularly be understood that the specific control system, including computer and circuitry, for controlling the vehicle parking system forms no part of the present invention, and thus has not been described or illustrated. More specifically, it is believed that the level of skill of those in the computer field is such that they would be easily able to select a computer and design the program and circuitry necessary to control the various components of the present invention.

What is claimed is:

1. An automated vehicle parking system comprising:

a large vehicle parking area having a floor and ceiling and free of intermediate floors;

said floor having thereon a plurality of intersecting tracks extending perpendicularly to each other;

a plurality of towers movable along said tracks, each of said towers having therein a plurality of vehicle supporting floors;

said vehicle parking area having vehicle extrance and exit means;

means operatively associated with said entrance and exit means and said towers for transferring vehicles to and from said floors of said towers; and means for selectively engaging and moving said towers between said entrance and exit means to and from predetermined positions in said vehicle parking area, said tower moving means comprising at least one power car movable on said tracks beneath said towers, said power car having mounted thereon means for selectively altering the direction of movement of said power car along said perpendicularly intersecting tracks, and said power car having thereon upwardly extendible jack means for selectively engaging and lifting a tower positioned above said power car.

2. A system as claimed in claim 1, wherein said entrance and exit means comprises cargo hoist units having at least one vertically movable vehicle floor.

3. A system as claimed in claim 2, wherein said transferring means comprises shovels mounted in each said floor of said cargo hoist unit.

4. A system as claimed in claim 3, further comprising means for selectively raising and lowering said shovels and for selectively moving said shovels horizontally.

5. A system as claimed in claim 1, wherein said direction altering means comprises, at each of four corners of said power car, a wheel truck mounted to said power car to pivot in a horizontal plane about a vertical shaft, each said wheel truck having wheels movable on said tracks; means associated with each wheel truck to cause rotation of said wheels to move said power car along said tracks; and means associated with each said vertical shaft for selectively rotating said shaft and thereby said associated wheel truck 90°.

6. A system as claimed in claim 1, wherein said power car has at each of said corners an upwardly extendible jack means to selectively lift a tower positioned above said power car.

7. A system as claimed in claim 6, wherein said power car has at each of said corners a downwardly extendible jack to selectively lift said power car.

* * * * *